US007300127B2

(12) United States Patent
Konno

(10) Patent No.: US 7,300,127 B2
(45) Date of Patent: Nov. 27, 2007

(54) INKJET RECORDING APPARATUS AND RECORDING METHOD

(75) Inventor: Masaaki Konno, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 276 days.

(21) Appl. No.: 10/940,728

(22) Filed: Sep. 15, 2004

(65) Prior Publication Data

US 2005/0057591 A1 Mar. 17, 2005

(30) Foreign Application Priority Data

Sep. 16, 2003 (JP) ..... 2003-323388

(51) Int. Cl.
*B41J 29/38* (2006.01)
*B41J 2/205* (2006.01)

(52) U.S. Cl. ..... 347/13; 347/15

(58) Field of Classification Search ..... 347/13, 347/15

See application file for complete search history.

(56) References Cited

U.S. PATENT DOCUMENTS 4,617,580 A * 10/1986 Miyakawa ..... 346/136
6,264,298 B1 * 7/2001 Mantell ..... 347/15
6,343,846 B1 * 2/2002 Asano ..... 347/14
6,402,280 B2 * 6/2002 Kneezel et al. ..... 347/15
6,460,962 B1 * 10/2002 Dietl et al. ..... 347/19
6,540,326 B2 * 4/2003 Matsubara et al. ..... 347/41
6,648,441 B2 * 11/2003 Naoi ..... 347/13
2003/0016268 A1 1/2003 Hickman et al.
2003/0038853 A1 * 2/2003 Moroo ..... 347/15
2004/0095421 A1 5/2004 Hickman et al.

FOREIGN PATENT DOCUMENTS

JP 10-157135 A 6/1998
JP 10-235854 A 9/1998
JP 2000-326497 A 11/2000
JP 2001-253119 A 9/2001
JP 2003-11335 A 1/2003
JP 2003-118098 A 4/2003

* cited by examiner

*Primary Examiner*—Matthew Luu
*Assistant Examiner*—Shelby Fidler
(74) *Attorney, Agent, or Firm*—Birch, Stewart, Kolasch & Birch, LLP

(57) ABSTRACT

The inkjet recording apparatus comprises: a full line type recording head which includes a plurality of nozzles for discharging ink arranged in a nozzle row across an entire printable width in a main scanning direction; a conveyance device which moves a recording medium and the recording head relatively to each other in a sub-scanning direction substantially orthogonal to the nozzle row provided in the recording head; and a droplet ejection control device which controls a droplet ejection timing of each nozzle, in such a manner that a basic arrangement of droplet deposition points of dots formed on the recording medium by means of ink droplets ejected from the nozzles becomes a staggered lattice arrangement.

2 Claims, 18 Drawing Sheets

400

INKJET RECORDING APPARATUS AND RECORDING METHOD

This Non-provisional application claims priority under 35 U.S.C. § 119(a) on Patent Application No(s). 2003-323388 filed in Japan on Sep. 16, 2003, the entire contents of which are hereby incorporated by reference.

BACKGROUND OF THE INVENTION

1. Field of the Invention

The present invention relates to an inkjet recording apparatus and recording method, and more particularly, to control technique for an inkjet recording apparatus using a line head wherein a plurality of recording elements are arranged in one direction.

2. Description of the Related Art

Recently, inkjet recording apparatuses (inkjet printers) have become common as recording apparatuses for printing and recording images captured by digital still cameras, and the like. Inkjet recording apparatuses are relatively inexpensive, and not only are they straightforward to use, they also have the merit of yielding images of good quality. An ink-jet recording apparatus comprises a plurality of recording elements in a head, the recording head scanning a recording medium while droplets of ink are ejected toward the recording medium from the recording elements, and each time one line of an image is recorded onto recording paper, the recording medium is conveyed through a distance corresponding to one line, this process being repeated, whereby an image is formed onto the recording paper.

Inkjet printers include those which use a fixed-length serial head, and carry out recording by moving the head to scan a recording medium in the lateral direction of the recording medium, and those which use a line head in which recording elements are aligned up to a dimension corresponding to the full width of one edge of the recording medium. In a printer using a line head, it is possible to carry out image recording across the full surface of the recording medium, by scanning the recording medium in an orthogonal direction to the direction in which the recording elements are arranged. In a printer using a line head, it is not necessary to provide a conveyance system, such as a carriage, or the like, for moving a short-dimension head to scan the recording medium, and furthermore, movement of the carriage and complex scanning control of the recording medium also becomes unnecessary. Furthermore, since only the recording medium is moved, it is possible to achieve increase the recording speed in comparison to printers using serial heads.

In the recording device and control method disclosed in Japanese Patent Application Publication No. 10-157135, a plurality of nozzle rows for making the same line are provided, and ink is ejected as droplets onto a recording medium, by selective use of these nozzle rows.

Moreover, in the inkjet printer disclosed in Japanese Patent Application Publication No. 10-235854, a device for causing a nozzle row provided in a line head to oscillate is provided, whereby the visual perception of streaks of unevenness is lessened by causing the nozzle row to oscillate very slightly in the direction of alignment of the nozzle row. Furthermore, the aforementioned reference also discloses an embodiment wherein ink is ejected while causing the head to move in the direction of alignment of the nozzle row, and an embodiment wherein ink is ejected while causing the recording paper to move in the direction of alignment of the nozzle row.

In the printing method for an inkjet printing apparatus disclosed in Japanese Patent Application Publication No. 2000-326497, the visual perception of streaks of unevenness is lessened by increasing the dot size ejected, at uniform intervals.

However, in an inkjet recording apparatus which comprises a fixed row of nozzles which cover the full width of the image area, and which performs image recording by conveying the recording medium in a direction orthogonal to the row of nozzles, then since the drawing of a line parallel to the direction of conveyance is carried out by means of a single nozzle only, if there is variation in the dot position due to fluctuation in the direction of ejection from each nozzle, or the like, then a streak of unevenness in the direction of conveyance is likely to be perceived in the image.

In the recording apparatus disclosed in Japanese Patent Application Publication No. 10-157135, since a plurality of nozzle rows are provided, the number of nozzles is increased by the corresponding multiple, and therefore costs and the maintenance burden are markedly increased.

Moreover, in the inkjet printer disclosed in Japanese Patent Application Publication No. 10-235854, not only is it necessary to provide a high-precision mechanism for causing minute oscillation of the nozzle rows, thereby leading to high costs, but furthermore, there is also the concern that image quality is degraded by the minute oscillations.

In the printing method for an inkjet printing apparatus disclosed in Japanese Patent Application Publication No. 2000-326497, it is necessary to provide complex control of the image processing, and furthermore, adverse affects, such as poorer granularity in the output image, occur.

SUMMARY OF THE INVENTION

The present invention has been implemented taking into account the above described circumstances, and an object thereof is to provide an inkjet recording apparatus and a recording method for same whereby the visual perception of image deterioration, such as streaks of unevenness, and the like, can be lessened in an inkjet recording apparatus comprising a full line-type recording head.

In order to attain the above-described object, the present invention is directed to an inkjet recording apparatus, comprising: a full line type recording head which includes a plurality of nozzles for discharging ink arranged in a nozzle row across an entire printable width in a main scanning direction; a conveyance device which moves a recording medium and the recording head relatively to each other in a sub-scanning direction substantially orthogonal to the nozzle row provided in the recording head; and a droplet ejection control device which controls a droplet ejection timing of each nozzle, in such a manner that a basic arrangement of droplet deposition points of dots formed on the recording medium by means of ink droplets ejected from the nozzles becomes a staggered lattice arrangement.

According to the present invention, since the inkjet recording apparatus having a full line type recording head is composed in such a manner that the basic arrangement of ejected droplets is caused to be a staggered lattice arrangement, by means of a droplet ejection control device, then it is possible to lessen the perceptibility of streak which occurs when there is variation in the position of the dots, due to variation in the direction of ejection when the ink is ejected from the nozzles.

The basic arrangement signifies the arrangement formed by the original droplet deposition points (the dot positions on the image data) as determined on a theoretical basis. The actual positions of the dots are determined by the image recorded, and there may be droplet deposition points where no dots are formed, in addition to which, the actual positions of the dots may be situated in a region considered to be erroneous with respect to the original droplet deposition points.

Ink droplets are ejected from the nozzles onto the recording medium, and the printed medium onto which text, an image, or the like, is formed on the surface thereof, by means of ink droplets, is either paper, such as continuous paper, cut paper, or the like, or resin sheet, metal sheet (metal plate), cloth, or the like. Furthermore, various other media may be used, aside from those described above.

The nozzles may be arranged in a direction (main scanning direction) which is orthogonal to the conveyance direction of the recording medium, or they may be arranged in a direction which forms a certain angle with respect to the main scanning direction.

In the inkjet recording apparatus, the droplet ejection control device preferably controls the droplet ejection timing of each nozzle in such a manner that the dots formed by ejection of droplets at different timings from adjacent nozzles, that ejected droplets forming adjacent dots projected to align in the main scanning direction, are mutually overlapping.

According to this aspect, it is possible achieve a staggered lattice arrangement by implementing droplet ejection control whereby there is a timing offset between the respective ejection timings of adjacently positioned nozzles which eject droplets forming adjacent dots projected to align in the main scanning direction. There are various modes for controlling the droplet ejection in such a manner that the ejection timing is offset, for example, there is a mode wherein the ejection timings of the nozzles are offset by half a phase. Naturally, other modes may also be adopted.

In the inkjet recording apparatus, the droplet ejection control device preferably controls at least one of a diameter of the dot, the droplet ejection timing of each nozzle, and a conveyance speed of the conveyance device in such a manner that the following inequality is satisfied: $D^2>N^2+(L/2)^2$, where D is the diameter of the dot, N is a projected nozzle interval when projected to align in the main scanning direction, and L is a projected droplet deposition interval when projected to align the droplet deposition points of a same nozzle in the sub-scanning direction.

According to this aspect, a beneficial effect is displayed in that the perceptibility of degradation in the print quality caused by variation in the ejection direction, and more particularly, streak in the sub-scanning direction, is lessened.

If the interval in the sub-scanning direction between the droplet deposition points ejected by the same nozzle is taken to be L, and the ejection timing of adjacent nozzles in the projected nozzle row that is projected such that the nozzles align in the main scanning direction is controlled so that the timing of each nozzle is offset by approximately half a phase, then the projected droplet deposition interval L of the droplet deposition points, as projected to align in the sub-scanning direction, is approximately L/2.

To make the projected droplet deposition interval L variable, the droplet ejection timing of each nozzle may be controlled, or the conveyance speed of the conveyance device may be controlled. Alternatively, both the droplet ejection timing and the conveyance speed may be controlled.

Preferably, the inkjet recording apparatus further comprises: an ink type determination device which determines a type of the ink to be ejected from the nozzle so as to acquire ink type information; and a recording medium type determination device which determines a type of the recording medium so as to acquire recording medium type information, wherein the droplet ejection control device determines an ejection amount of the ink droplets to be ejected from the nozzle and controls the diameter of the dot according to at least one of the ink type information and the recording medium type information.

According to this aspect, the droplet ejection amount is controlled on the basis of the ink type and the recording medium type, and hence ink is ejected in a droplet ejection amount corresponding to the ink type and the recording medium type. As a result, favorable dots are formed. In the inkjet recording apparatus, the droplet ejection control device preferably controls the droplet ejection timing of each nozzle, in such a manner that the basic arrangement of the droplet depositions points of the dots formed on the recording medium assumes a hexagonal lattice arrangement.

According to this aspect, if the droplet deposition points are arranged in a hexagonal lattice arrangement, then it is possible to enhance the effect of lessening the perceptibility of streak, yet further, in comparison with a staggered lattice arrangement.

Taking the projected nozzle interval when projected to align in the main scanning direction to be N, and the dot interval of the dot array (droplet deposition points) when projected to align in the sub-scanning direction to be L, then the hexagonal lattice arrangement includes at the least arrangements satisfying the relationship, $$L=\frac{2\times N}{\sqrt{3}}.$$

In order to attain the above-described object, the present invention is also directed to an inkjet recording apparatus, comprising: a full line type recording head which includes a plurality of nozzles for discharging ink arranged in a nozzle row across an entire printable width in a main scanning direction; a conveyance device which moves a recording medium and the recording head relatively to each other in a sub-scanning direction substantially orthogonal to the nozzle row provided in the recording head; and a droplet ejection control device which determines a basic arrangement of droplet deposition points of dots to be formed on the recording medium in accordance with a density of the dots to be formed on the recording medium, and controls a droplet ejection timing of each nozzle in such a manner that the basic arrangement of the droplet deposition points of the dots formed on the recording medium by ink droplets ejected from the nozzles assumes the basic arrangement thus determined.

According to the present invention, since a composition is adopted wherein the basic arrangement of the droplet deposition points is determined on the basis of the dot density formed on the recording medium, then it is possible to change the basic arrangement of the droplet deposition points in accordance with the input data.

The dot density may be determined on the basis of the printing mode of the ink-jet recording apparatus, or it may be determined on the basis of input data.

In the inkjet recording apparatus, the droplet ejection control device preferably controls the droplet ejection timing of each nozzle, in such a manner that: if the following inequality is satisfied: $D^2>N^2+(L/2)^2$, where the basic arrangement for the droplet deposition points of the dots formed on the recording medium is assumed to a staggered lattice arrangement, D is the diameter of the dot, N is a projected nozzle interval when projected to align in the main scanning direction, and L is a projected droplet deposition interval when projected to align the droplet deposition points of a same nozzle in the sub-scanning direction, then droplets are deposited in the staggered lattice arrangement as the basic arrangement; whereas if the above inequality is not satisfied, then droplets are deposited in a square lattice arrangement as the basic arrangement.

According to this aspect, in the case high-quality printing wherein the dot density is high, a staggered lattice arrangement is adopted for the basic arrangement of the dots, whereby the perceptibility of streak can be lessened. On the other hand, in the case of low-quality printing wherein the dot density is low, the perceptibility of streak can not be lessened, and therefore a square lattice is adopted as the basic arrangement of the dots, whereby the load involved in droplet ejection control is reduced.

Furthermore, the present invention also provides a method for attaining the above-described object. In other words, the present invention is also directed to a recording method for an inkjet recording apparatus comprising: a full line type recording head which includes a plurality of nozzles for discharging ink arranged in a nozzle row across an entire printable width in a main scanning direction; and a conveyance device which moves a recording medium and the recording head relatively to each other in a sub-scanning direction substantially orthogonal to the nozzle row provided in the recording head, the method comprising: controlling a droplet ejection timing of each nozzle in such a manner that ink droplets are ejected at different droplet ejection timings, from adjacent nozzles in the nozzle row, and a basic arrangement of droplet deposition points of dots formed on the recording medium by ink droplets ejected from the nozzles assumes a staggered lattice arrangement, and each dot overlaps with the dots most adjacent thereto; and recording an image on the recording medium, by causing ink droplets to be ejected from the nozzles onto the recording medium, while causing the recording medium and the recording head to move relatively to each other in a sub-scanning direction by means of the conveyance device.

A mode wherein a hexagonal lattice arrangement is adopted as the basic arrangement for the droplet deposition points of the dots can also be envisaged. Moreover, it is also possible to adopt a composition wherein the basic arrangement of the dots is changed in accordance with the density of the dots.

According to the present invention, in an inkjet recording apparatus comprising a full line type recording head, the dots formed on a recording medium by means of ink droplets ejected from the nozzles are arranged in a staggered lattice fashion, and furthermore, the droplet ejection timing is controlled in such a manner that each dot overlaps with the dots most adjacent to same. Consequently, it is possible to lessen the perceptibility of streak, even in cases where the dot formation positions are displaced, due to variation in the ejection direction of the ink droplets. By adopting a hexagonal lattice arrangement for the dot arrangement, instead of a staggered lattice arrangement, it is possible to raise the effect of lessening the perceptibility of the streak yet further.

Moreover, if a staggered lattice arrangement or a hexagonal lattice arrangement is adopted for the basic arrangement of the dots in the case of high-quality recording wherein the dot density is high, and a square lattice arrangement is adopted for same in the case of low-quality recording wherein the dot density is low, then the perceptibility of streak can be lessened during high-quality recording, while the control load can be reduced in the case of low-quality recording, where no effect in lessening the perceptibility of streaks can be expected.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Preferred embodiments of an inkjet recording apparatus and recording method relating to the present invention are described below with reference to the accompanying drawings.

Figure 1:
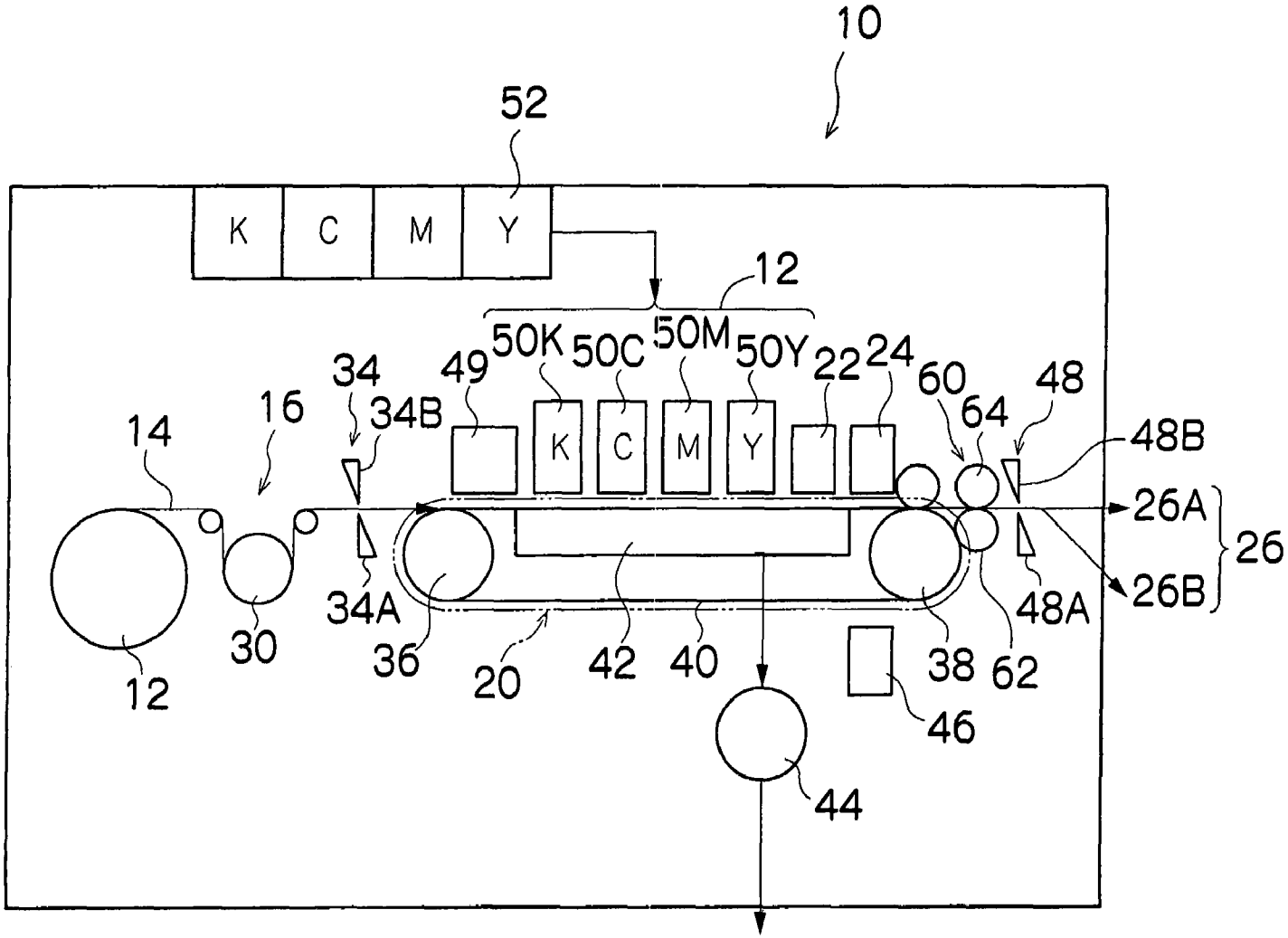
FIG. 1 is a block diagram of an inkjet recording apparatus according to an embodiment of the present invention.

FIG. 1 is a block diagram showing the composition of an inkjet recording apparatus 10 relating to an embodiment of the present invention.

The inkjet recording apparatus 10 is a printer which records data, such as images, by discharging liquid droplets onto recording paper 14, and it comprises a paper supply unit 12 for supplying recording paper 14, a decurling unit 16 for removing curl from the recording paper 14, a print unit 50 for recording data, such as an image, or the like, onto the recording paper 14 by causing ink droplets to be ejected from a plurality of print heads provided corresponding to respective colors of ink, a suction belt conveyance unit 20, provided in a position opposing the nozzle surface (ink ejection surface) of the print unit 50, for conveying the recording paper 14 while maintaining same in a flat state, a print determination unit 22 for reading in the results of printing by the print unit 50, an after drying unit 24 for posterior processing of the recording paper 14 which has been printed on, and an output unit 26 for outputting the printed recording paper 14, externally.

FIG. 1 shows a magazine for a roll of paper (continuous printing paper) as one example of the paper supply unit 12, but if the apparatus is composed in such a manner that it capable of using a plurality of types of printing paper, then a plurality of magazines of different paper widths and paper qualities can be used in a combined fashion. Moreover, it is also possible to provide a cassette into which cut paper is loaded in a stacked fashion, either in place of, or in combination with, the magazine for roll paper.

In a composition wherein a plurality of types of printing paper can be used, desirably, an information recording body, such as a bar code or a radio tag, or the like, on which information relating to the type of printing paper is recorded, is attached to the magazine, and the type of recording paper 14 to be used is distinguished automatically, by reading in the information on the information recording body by means of a prescribed reading device, the ejection of ink being controlled in such a manner that that ink ejection suitable to the type of recording paper 14 is carried out.

In a device composition using roll paper, as illustrated in FIG. 1, a shearing cutter (first cutter) 34 is provided and the roll paper is cut to a prescribed size by means of the cutter 34. The cutter 34 comprises a fixed blade 34B having a length at the least equal to or greater than the width of the conveyance path of the recording paper 14, and a circular blade 34A which moves along the fixed blade 34B, the fixed blade 34B being provided on the side to the rear of the printing paper, and the circular blade 34 being provided on the printing side, on the other side of the conveyance path, with respect to the fixed blade 34B. If cut paper is used, then the cutter 34 is not necessary.

The recording paper 14 supplied from the paper supply unit 12 contains some residual curl, due to the fact that it has been wound about a magazine. In order to eliminate this curl, in a decurling unit 16, the paper is heated by means of a heating drum 30, in the opposite direction to the direction of winding in the magazine. In this case, desirably, the heating temperature is controlled in such a manner that the paper assumes a slight curl towards the outer side of the printing surface.

After decurling, the cut recording paper 14 is supplied to the suction belt conveyance unit 20. The suction belt conveyance unit 20 has a structure wherein an endless belt 40 is wound between rollers 36, 38, and is composed in such a manner that at lest the portion thereof opposing the print unit 50 and the print determination unit 22 is horizontal (flat).

The belt 40 has a dimension that is broader than the width of the recording paper 14, and a plurality of suction holes (not illustrated) are formed in the surface of the belt. A suction chamber 42 is provided to the inner side of the conveyance belt 40 wound between the rollers 36, 38, at a position opposing the nozzle surface of the print unit 50 and the sensor surface of the print determination unit 22, and the recording paper 14 on the conveyance belt 40 is suctioned and held by means of the negative pressure caused by sucking out air from this suction chamber 42 by means of a fan 44.

Figure 6:
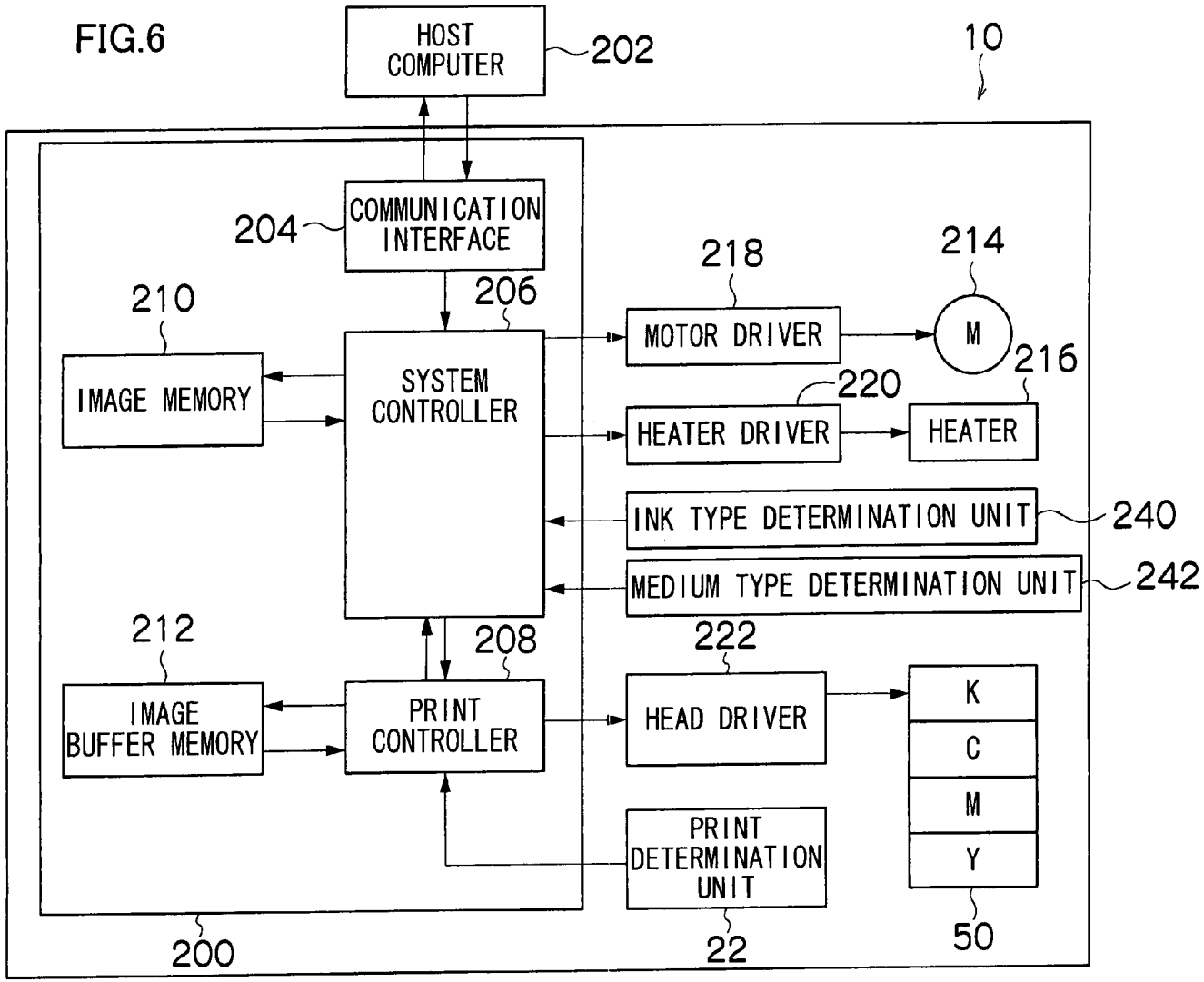
FIG. 6 is a system composition drawing of the inkjet recording apparatus illustrated in FIG. 1.

By transmitting the driving force of a motor (not illustrated in this drawing, and depicted as numeral 214 in FIG. 6,) to at least one of the rollers 36, 38 about which the belt 40 is wound, the belt 40 is driven in the clockwise direction in FIG. 1, and the recording paper 14 held on the belt 40 is conveyed from left to right in FIG. 1.

If a marginless image is printed, or the like, then ink adheres to the belt 40 also, and therefore, a belt cleaning unit 46 is provided at a prescribed position on the belt 40 (an appropriate position outside the printing region). Although the belt cleaning unit 46 is not illustrated in detail, it may be based, for example, on a system whereby the belt is nipped by a brush roller, a water supply roller, or the like, or an air-blower system in which cleaning air is blown onto the belt, or a combination of such systems. In a system where the belt is nipped between cleaning rollers, an important cleaning effect can be obtained if the linear speed of the belt and the linear speed of the rollers are different.

A situation may also be envisaged wherein a roller nip conveyance mechanism is used instead of the suction belt conveyance unit 20, but if the print region is conveyed by means of a roller nip system, then the roller makes contact with the printed surface of the recording paper 14 immediately after printing, and hence smudges are liable to appear in the image, for which reason, suction belt conveyance is desirable since the rollers do not make contact with the printed surface, in the printed region of the recording paper 14.

In the conveyance path formed by the suction belt conveyance unit 20, a heating fan 49 is provided to the forward side (upstream side) of the print unit 50. This heating fan 49 blows heated air onto the recording paper 14 before printing, and thereby heats up the recording paper 14. Heating the recording paper 14 before printing means that the ink dries more readily after landing on the recording paper 14.

The print unit 50 is a so-called full-line head in which print heads (line heads) 50Y, 50M, 50C, 50K having a length corresponding to the maximum paper width are disposed in an orthogonal direction (main scanning direction) with respect to the conveyance direction of the recording paper 14 (sub-scanning direction).

The detailed structure is described hereinafter, but each print head 50Y, 50M, 50C, 50K is constituted by a line type head wherein a plurality of ink ejection holes (nozzles) are arranged to a length which exceeds at least one edge of the maximum size of recording paper 14 which can be used in the present inkjet recording apparatus 10. Print heads 50K, 50C, 50M, 50Y corresponding to respective ink colors are disposed in the order, black (K), cyan (C), magenta (M) and yellow (Y), from the upstream side, following the direction of conveyance of the recording paper 14 (the paper conveyance direction). By discharging ink of respective colors from the respective print heads, while conveying the recording paper 14, it is possible to form a color image on the recording paper 14.

In the present example, a composition involving the standard colors, KCMY, is described, but there is no limit on the combination of ink colors, or the number of ink colors, in the present embodiment, and pale inks or dark inks may also be added, according to requirements. For example, a composition may also be adopted wherein print heads for discharging light color inks, such as light cyan, light magenta, or the like, are also added.

As shown in FIG. 1, the ink storing and loading unit 52 has tanks for storing inks of the colors corresponding to the respective print heads 50K, 50C, 50M and 50Y, and each tank is connected to a respective print head 50K, 50C, 50M, 50Y, via a tube passage (not illustrated). Moreover, the ink storing and loading unit 52 also comprises a notifying device (display device, alarm generating device, or the like) for generating a notification if the remaining amount of ink has become low, as well as having a mechanism for preventing incorrect loading of the wrong color ink.

The print determination unit 22 is a device for checking for discharging errors, such as nozzle blockages, or the like, and it comprises an image sensor for capturing an image of the results of droplet ejection. For the print determination unit 22 according to the present embodiment, a line sensor is used which has a photoreceptor array having a width that is at the least greater than the width of ink ejection (image recording width) achieved by the respective print heads.

An after drying unit 24 is provided at a downstream stage from the print determination unit 22. The after drying unit 24 is a device for drying the printed surface, and it may comprise, for example, a heating fan. It is desirable to avoid contact with the printed surface until the printing ink has dried, and therefore, a system for blowing heated air is preferable.

In cases where a dye type ink is printed onto a porous paper, or the like, if the pores in the paper are sealed by applying pressure, then this prevents contact with substances, such as ozone, or the like, which may break down the dye molecules, and therefore has the effect of increasing the durability of the image.

In order to control the luster of the image surface, a heating and pressurizing unit 60 applies pressure to the printed surface, by means of pressure rollers 62, 64 having prescribed surface indentations, while heating same, and hence an indented form is transferred to the image surface.

The printed object generated in this manner is output via the paper output unit 26. Desirably, the actual image that is to be printed (the printed copy of the desired image), and test prints, are output separately. In this inkjet recording apparatus 10, a selecting device (not illustrated) is provided for switching the paper output path, in order that a print of the target image, and a print of a test image are sent selectively to respective paper output units 26A, 26B. If the target image and the test print are formed simultaneously in a parallel fashion, on a large piece of printing paper, then the portion corresponding to the test print is cut off by means of the cutter (second cutter 48). The cutter 48 is disposed immediately in front of the paper output section 26, and it serves to cut and separate the target image from the test print section, in cases where a test image is printed onto the white margin of the image. The structure of the cutter 48 is similar to that of the first cutter 34 described previously, being constituted by a fixed blade 48B and a circular blade 48A.

Moreover, although not shown in FIG. 1, a sorter for collating and stacking the images in respective orders is provided in the paper output section 26A corresponding to the target images. Numeral 26B denotes a paper output section for test prints.

Next, the structure of a print head is described. Since the structure of the respective print heads 50K, 50C, 50M and 50Y provided for each respective ink colors are similar, below, a print head is designated by the numeral 50, as a representative example of these print heads.

Figure 2A:
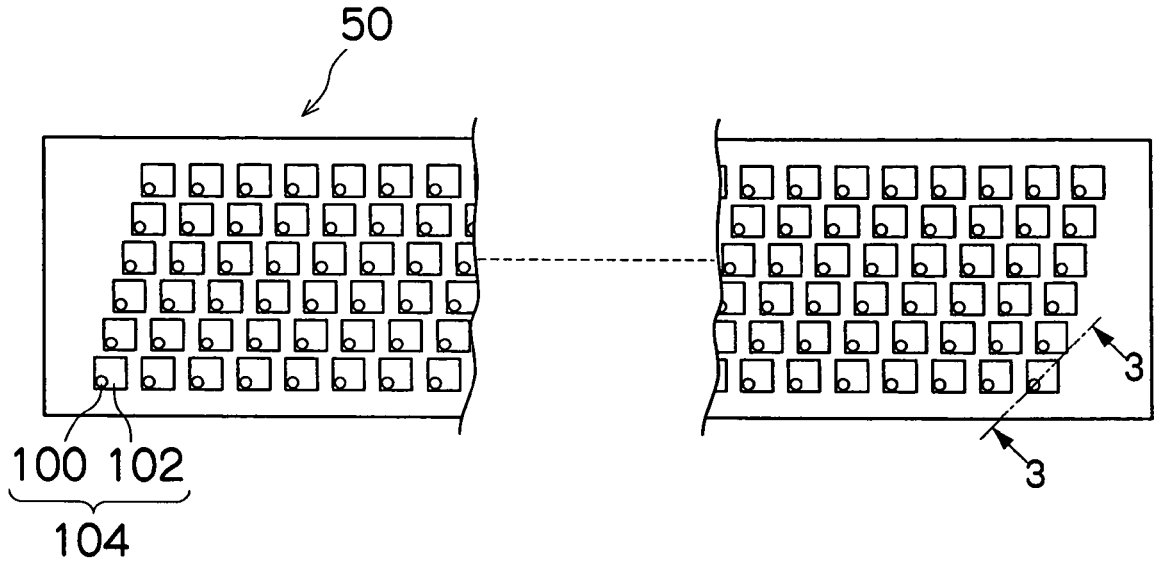
FIG. 2A is a plan view perspective drawing showing an example of the composition of a print head.
Figure 2B:
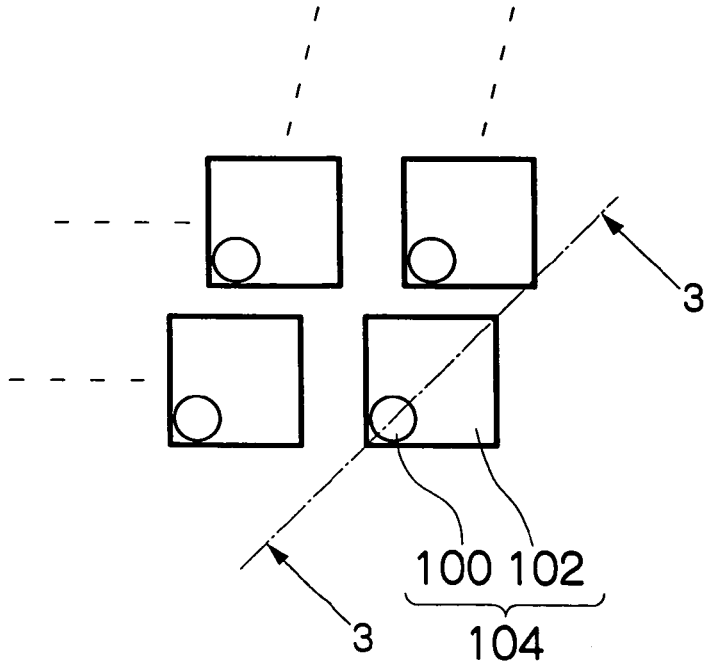
FIG. 2B is an enlarged view of the principal part of FIG. 2A.
Figure 2C:
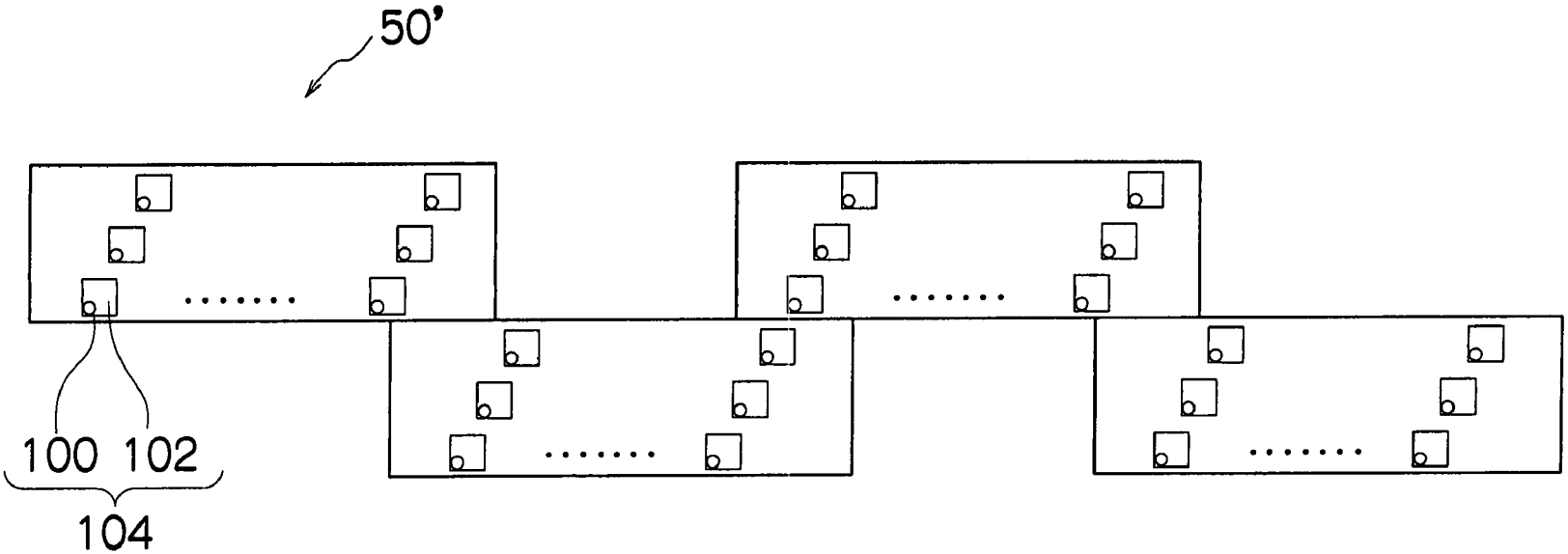
FIG. 2C is a plan view perspective drawing showing another example of the composition of a print head.
Figure 3:
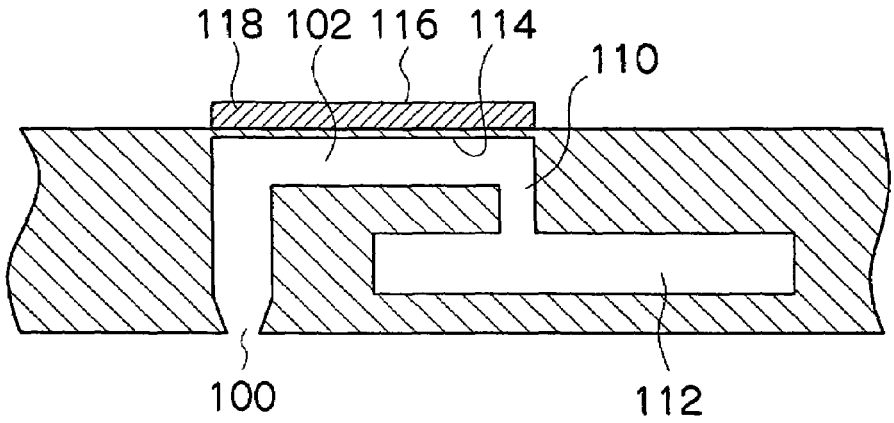
FIG. 3 is a cross-sectional view along line 3-3 in FIG. 2A.

FIG. 2A is a plan view perspective drawing showing an example of the composition of a print head 50, and FIG. 2B is an enlarged drawing of a portion of same. Furthermore, FIG. 2C is a plan view perspective drawing showing a further example of the composition of a print head 50, and FIG. 3 is a cross-sectional drawing showing a three-dimensional composition of an ink chamber unit (being a cross-sectional view along line 3-3 in FIG. 2A). In order to achieve a high density of the dot pitch printed onto the surface of the recording medium, it is necessary to achieve a high density of the nozzle pitch in the print head 50. As shown in FIGS. 2A to 2C and 4, the print head 50 according to the present example has a structure wherein a plurality of ink chamber units 104, each comprising a nozzle 100 from which ink droplets are ejected, and a pressure chamber 102 corresponding to each nozzle 100, and the like, are disposed in a staggered lattice fashion, whereby a high density of the apparent nozzle pitch is achieved.

More specifically, as shown in FIGS. 2A and 2B, the print head 50 according to the present embodiment is a full-line head having one or more than one row of nozzles arranged along a length corresponding to the full width of the print medium (recording paper 14), in a direction substantially orthogonal to the direction of conveyance of the print medium (the paper conveyance direction).

Moreover, as shown in FIG. 2C, it is also possible to use respective heads 50' of nozzles arranged to a short length in a two-dimensional fashion, and to combine same in a staggered lattice arrangement, whereby a length corresponding to the full width of the print medium is achieved.

Figure 4:
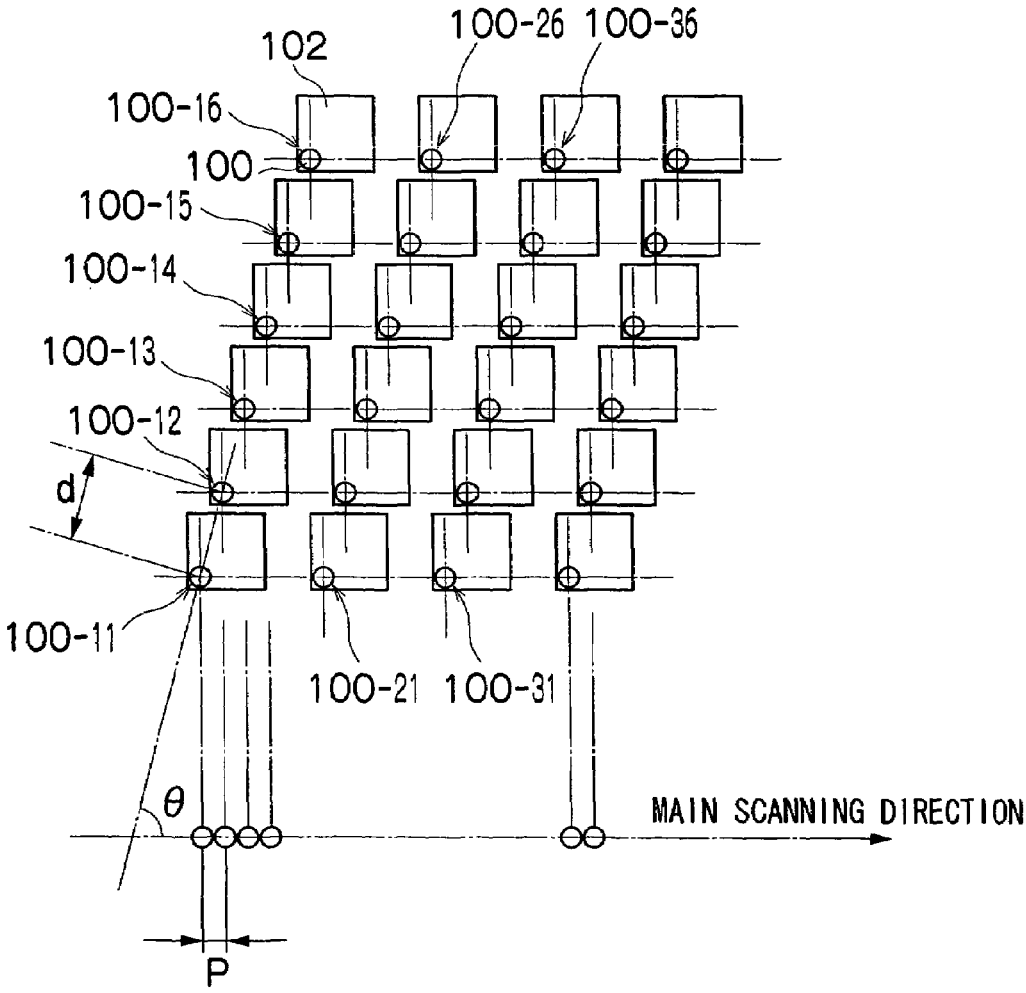
FIG. 4 is an enlarged view showing a nozzle arrangement in the print head illustrated in FIG. 2A.

The pressure chamber 102 provided corresponding to each of the nozzles 100 is substantially square-shaped in plan view, and a nozzle 100 and a supply port 110 are provided at respective corner sections situated in mutually symmetrical positions. As shown in FIG. 4, each pressure chamber 102 is connected to a common flow passage 112 via the supply port 110.

An actuator 118 provided with an individual electrode 116 is joined to a pressure plate 114 which forms the ceiling face of the pressure chamber 102, and the actuator 118 is deformed when a drive voltage is supplied to the individual electrode 116, thereby causing ink to be ejected. When ink is ejected, new ink is supplied to the pressure chamber 102, from the common flow passage 112, via the supply port 110.

As shown in FIG. 4, the plurality of ink chamber units 104 having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure wherein a plurality of ink chamber units 104 are arranged at a uniform pitch d in a direction having an angle $\theta$ with respect to the main scanning direction, the pitch P of the nozzles when projected to align in the main scanning direction is $d \times \cos\theta$.

More specifically, the arrangement can be treated equivalently to one wherein the respective nozzles 100 are arranged in a linear fashion at uniform pitch P, in the main scanning direction. By means of this composition, it is possible to achieve a nozzle composition of high density, wherein the nozzle columns projected to align in the main scanning direction reach a total of 2400 per inch (2400 nozzles per inch). Below, in order to facilitate the description, it is supposed that the nozzles 100 are arranged in a linear fashion at a uniform pitch (P), in the longitudinal direction of the head (main scanning direction).

In a full-line head having a row of nozzles which corresponds to the full width of the printing paper (recording paper 14), when the nozzles are driven, either (1), all of the nozzles are driven simultaneously, or (2) the nozzles are drive successively from one side towards the other side, or (3) the nozzles are divided up into blocks and are driven successively in these blocks, from one side towards the other, and the driving of the nozzles in order to print a single line or a single band in the width direction of the printing paper (the direction orthogonal to the direction of conveyance of the printing paper) is defined as main scanning.

In particular, if driving nozzles arranged in a matrix fashion, as illustrated in FIG. 4, then main scanning as described in (3) above is desirable. More specifically, one line is printed in the width direction of the printing paper 14, by taking the nozzles 100-11, 100-12, 100-13, 100-14, 100-15, 100-16 as one block (and also taking nozzles 100-21, . . . , 100-26 as one block, nozzles 100-31, . . . 100-36 as one block, and so on), and driving the nozzles 100-11, 100-12, . . . , 100-16 successively in accordance with the speed of conveyance of the recording paper 14.

On the other hand, sub-scanning is defined as the operation of moving the printing paper relatively to the full-line head described above, whereby the printing of one line or one is hand formed by main scanning described above is repeated.

When implementing the present invention, the arrangement of the nozzles is not limited to that of the example illustrated. Moreover, in the present embodiment, a method is employed wherein an ink droplet is ejected by means of the deformation of the actuator 118, which is, typically, a piezoelectric element, but in implementing the present invention, the method used for discharging ink is not limited in particular, and instead of a piezo jet method, it is also possible to apply various other types of methods, such as a thermal jet method, wherein the ink is heated and bubbles are caused to form therein, by means of a heat generating body, such as a heater, ink droplets being ejected by means of the pressure of these bubbles.

Figure 5:
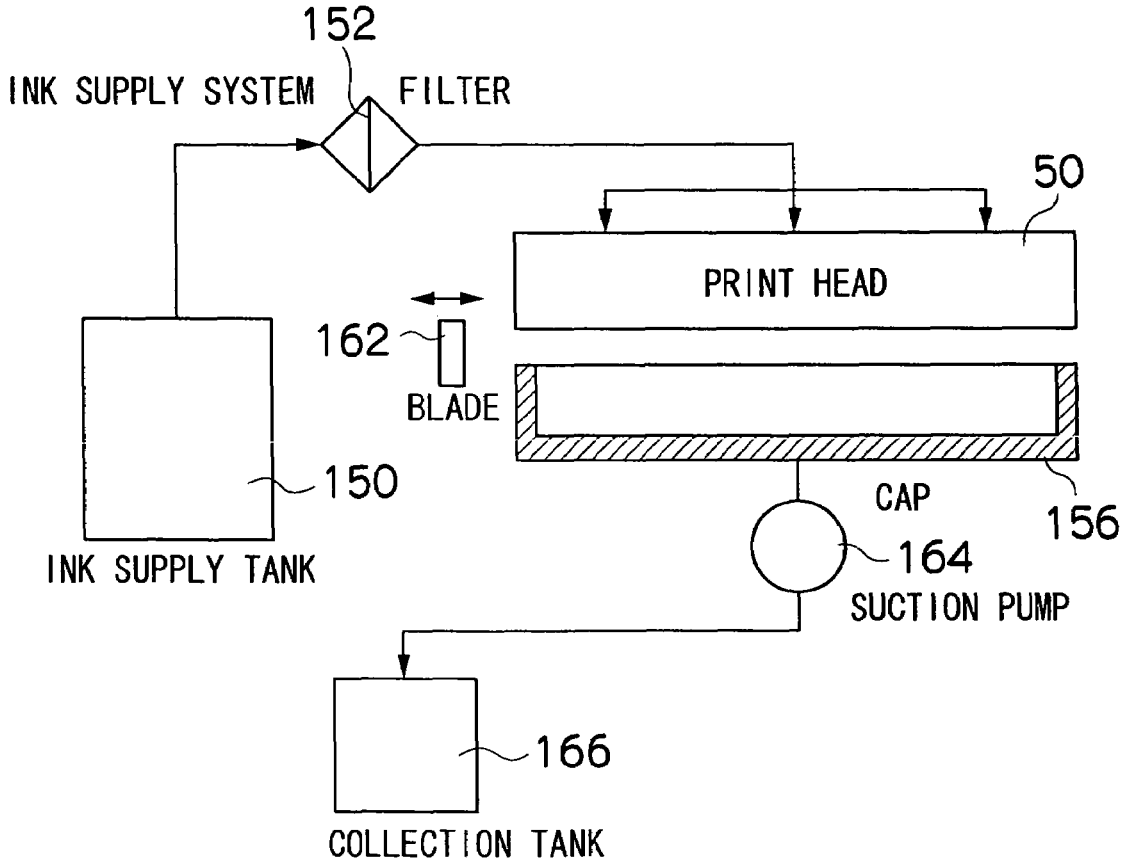
FIG. 5 is a block diagram of an ink supply unit of the inkjet recording apparatus illustrated in FIG. 1.

FIG. 5 is a conceptual drawing showing the composition of an ink supply system in the inkjet recording apparatus 10.

The ink supply tank 150 is the base tank for supplying ink, and is it disposed in the ink storing and loading unit 52 illustrated in FIG. 1. The ink supply tank 150 may adopt a system for replenishing ink by means of a replenishing opening (not illustrated), or a cartridge system wherein cartridges are exchanged independently for each tank, whenever the residual amount of ink has become low. If the type of ink is changed in accordance with the use application, then a cartridge based system is suitable. In this case, desirably, type information relating to the ink is identified by means of a bar code, or the like, and the ejection of the ink is controlled in accordance with the ink type. The ink supply tank 150 in FIG. 5 is equivalent to the ink storing and loading unit 52 shown in FIG. 1 and described above.

As shown in FIG. 5, a filter 152 is provided between the ink supply tank 150 and the print head 50, in order to remove foreign matter and air bubbles. Desirably, the filter mesh size is the same as the nozzle diameter, or smaller than the nozzle diameter (generally, about 20 μm).

Although not illustrated in FIG. 5, desirably, a composition is adopted wherein a subsidiary tank is provided in the vicinity of the print head 50, or in an integral fashion with the print head 50. The subsidiary tank has the function of improving damping effects and refilling, in order to prevent variations in the internal pressure inside the head.

Furthermore, the inkjet recording apparatus 10 is also provide with a cap 156, being a device for preventing the nozzles 100 from drying out and preventing increase in the viscosity of the ink in the vicinity of the nozzles, and a cleaning blade 162 forming a device for cleaning the surface of the nozzles 100.

A maintenance unit comprising the cap 156 and the cleaning blade 162 is able to move relatively with respect to the print head 50, by means of a movement mechanism (not illustrated), and it is moved from a prescribed withdrawn position to a maintenance position below the print head 50, as and when necessary.

The cap 156 is displaced upwards and downwards relatively to the print head 50, by means of a raising and lowering mechanism (not illustrated). When the power supply is off, or when the apparatus is at standby, the cap 156 is raised to a prescribed raised position and sealed tightly onto the print head 50, thereby covering the nozzle surface (ink ejection surface).

During printing, or during standby, if the use frequency of a particular nozzle 100 is low, and if it continues in a state of not discharging ink for a prescribed time period or more, then the solvent in the ink in the vicinity of the nozzle evaporates and the viscosity of the ink increases. In a situation of this kind, it becomes impossible eject ink from the nozzle 51, even if the actuator 118 is operated.

Therefore, before a situation of this kind develops (namely, while the ink is within a range of viscosity which allows its ejection by operation of the actuator 118), the actuator 118 is operated, and a preliminary discharge (purge, air discharge, liquid discharge) is carried out in the direction of the cap 156 (ink receptacle), in order to expel the degraded ink (namely, the ink in the vicinity of the nozzle which has increased viscosity).

Furthermore, if air bubbles enter into the ink side the print head 50 (inside the pressure chamber 102), then even if the actuator 118 is operated, it is not possible eject ink from the nozzle. In a case of this kind, the cap 156 is placed on the print head 50, the ink (ink containing air bubbles) inside the pressure chamber 102 is removed by suction, by means of a suction pump 164, and the ink removed by suction is then supplied to a collection tank 166. This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 102, the ink consumption increases. Therefore, desirably, preliminary discharge is carried out in cases where the amount of increase in the viscosity of the ink is small.

The cleaning blade 162 is constituted by an elastic member made of rubber, or the like, which is capable of sliding over the ink ejection surface (nozzle plate surface) of the print head 50, by means of a blade movement mechanism (wiper), which is not illustrated. If there are ink droplets or foreign matter adhering to the nozzle plate, then the nozzle plate surface is wiped by causing the cleaning blade 162 to slide over the nozzle plate, thereby cleaning the nozzle plate surface. When the soiling on the ink ejection surface has been cleaned away by means of the blade mechanism, preliminary discharge is carried out in order to prevent infiltration of foreign matter inside the nozzles 100, as a result of the blade.

Next, the control implemented in the inkjet recording apparatus 10 is described.

FIG. 6 is a principal block diagram showing the system composition of the ink-jet recording apparatus 10. The system control unit 200 of the inkjet recording apparatus 10 comprises: a communication interface 204 for acquiring data sent by a host computer 202; a system controller 206 for performing integrated control of the respective units on the basis of the image data; a print control unit 208 and image memory 210 for controlling the print heads; and an image buffer memory 212.

Image data sent from a host computer 202 is read into the inkjet recording apparatus 10 via the communication interface 204, and it is stored temporarily in the image memory 210. The image data thus read in is decompressed, and a conveyance system control signal for controlling the motor 214 of the suction belt conveyance unit 20 and the heater 216 is generated. The conveyance system control signal is supplied by the system controller 206 to the motor driver 218 and the heater driver 220.

In the print control unit 208, processing, such as various treatments, corrections, and the like, are carried out in order to output the image data supplied from the image memory 210, to the print head 50. Necessary processing is carried out in the print control unit 208, and the amount of ink ejected and the ejection timing in the print head 50 are controlled, via the head driver 222, on the basis of the image data. Furthermore, various corrections are made with respect to the print head 50, on the basis of information obtained from the print determination unit 22, according to requirements. An image buffer memory 212 for temporarily storing image data, parameters, and the like, during image data processing, is provided in the print control unit 208.

For the communication interface 204, a serial interface, such as USB, IEEE 1394, the Internet, or a wireless network, or the like, or a parallel interface, such as Centronics, or the like, can be used.

The system controller 206 may be constituted by a CPU (computing unit), an image processing IC (DSP), and a memory controller, or it may be constituted by an IC (processor) which incorporates these functions in a single chip.

A RAM is used for the image memory 210, but it is also possible to use a magnetic medium, such as a hard disk, or the like, rather than a semiconductor element.

Here, an example is described wherein an image buffer memory 212 is provided is appended to the print control unit 208, but it is also possible to make combined use of the image memory 210. Furthermore, it is also possible to use a memory incorporated into the processor used for the print control unit 208.

The head driver 222 drives the actuators (marked by numeral 118 in FIG. 3) of the respective colors heads, on the basis of the image data from the print control unit 208. A feedback control system for maintaining uniform driving conditions in the heads may also be incorporated into the head driver 222.

The print determination unit 22 reads in the printed image, performs prescribed signal processing, and then determines the printing situation, such as ejection failures, variations in droplet deposition, and the like, for each nozzle, and sends the results to the print control unit 208.

In an inkjet recording apparatus 10 comprising a print head 50 having a length that corresponds to the maximum paper width, as described above, a line drawn parallel to the sub-scanning direction is drawn by the same nozzle, and therefore, if the dot position varies due to fluctuation in the direction of ejection of the ink droplets, then this is readily visible in the form of streak of unevenness in the sub-scanning direction. Variation in the direction of ejection of the ink droplets is caused, for instance, by soiling of the surface of the nozzle, and the like.

The inkjet recording apparatus 10 further comprises an ink type determination unit (ink type determination device) 240 for acquiring information about the type of the ink to be used and a medium type determination unit (recording medium type determination device) 242 for acquiring information about the type of the recording paper 14 (medium type) to be used.

The ink type determination unit 240 reads ink type information (ID information) from an information recording body such as a barcode or a wireless tag attached to the ink cartridge on which information regarding the type of the ink is recorded, and transmits the read ink type information to the system controller 206.

The medium type determination unit 242 reads medium type information (ID information) from an information recording body such as a barcode or a wireless tag attached to the magazine on which information regarding the type of the recording paper 14 is recorded, and transmits the read medium type information to the system controller 206.

According to the ink type information and the medium type information transmitted from the ink type determination unit 240 and the medium type determination unit 242, the system controller 206 controls the print controller 208 to perform ink ejection control for controlling the ink droplet ejection timing (the conveyance speed of the recording paper 14), the ink droplet ejection amount, and so on, in order to realize appropriate ink ejection corresponding to the ink type and the recording paper 14 type.

An aspect may be applied to the ink type determination unit 240 in which an operator inputs ink type information using an input device not shown in the drawings (i.e., the operator specifies the ink to be used from a menu screen), and another aspect may be applied in which the ink ejected onto the recording paper 14 is read by a sensor such as a CCD, and the ink type is determined automatically from the reading result.

An aspect may be applied to the medium type determination unit 242 in which the operator inputs medium type information using an input device not shown in the drawings (i.e., the operator specifies the recording paper 14 to be used from a menu screen), and another aspect may be applied in which the recording paper 14 is identified automatically from the surface condition, thickness, and so on of the recording paper 14.

Next, the control of the ejection of ink droplets whereby the visual perceptibility of streak in the sub-scanning direction is lessened is described.

The basic arrangement of the dots is taken to be a staggered lattice arrangement, or a hexagonal lattice arrangement, and the droplet ejection timing is controlled in such a manner that adjacent dots mutually overlap, whereby the visual perceptibility of streak which is liable to occur in the sub-scanning direction in particular, can be lessened.

The basic arrangement of the dots indicates the theoretical center point of each dot, in other words, the arrangement of the ejected droplets. In practice, each dot is formed in a displaced position having an error component with respect to the position at which it is formed theoretically, due to variation in the direction of ejection of the ink, and the like. Furthermore, depending on the data (image) to be printed, there may be droplet deposition points where no dot is formed.

In the present embodiment, the staggered lattice arrangement indicates an arrangement wherein the droplet deposition points are formed at points where the interval between deposited droplets from one nozzle and a nozzle adjacent to same, as projected to align in the sub-scanning direction, is one half the interval between droplets deposited by the same nozzle, in the sub-scanning direction. The relationship between the droplet deposition interval L of a particular nozzle in the sub-scanning direction, and the droplet deposition interval between a particular nozzle and an adjacent nozzle, when projected to align in the sub-scanning direction, is not limited to this, and it can be set as desired, in accordance with the conditions of the droplet ejection control.

Moreover, a hexagonal lattice arrangement indicates a staggered lattice arrangement wherein the relationship between the nozzle pitch N and the droplet deposition interval L of a particular nozzle in the sub-scanning direction is expressed by the following equation (1):

$$L = \frac{2 \times N}{\sqrt{3}}. \quad (1)$$

This indicates a relationship wherein the droplet deposition point of each dot is spaced equidistantly from the three dots nearest to same.

Figure 7:
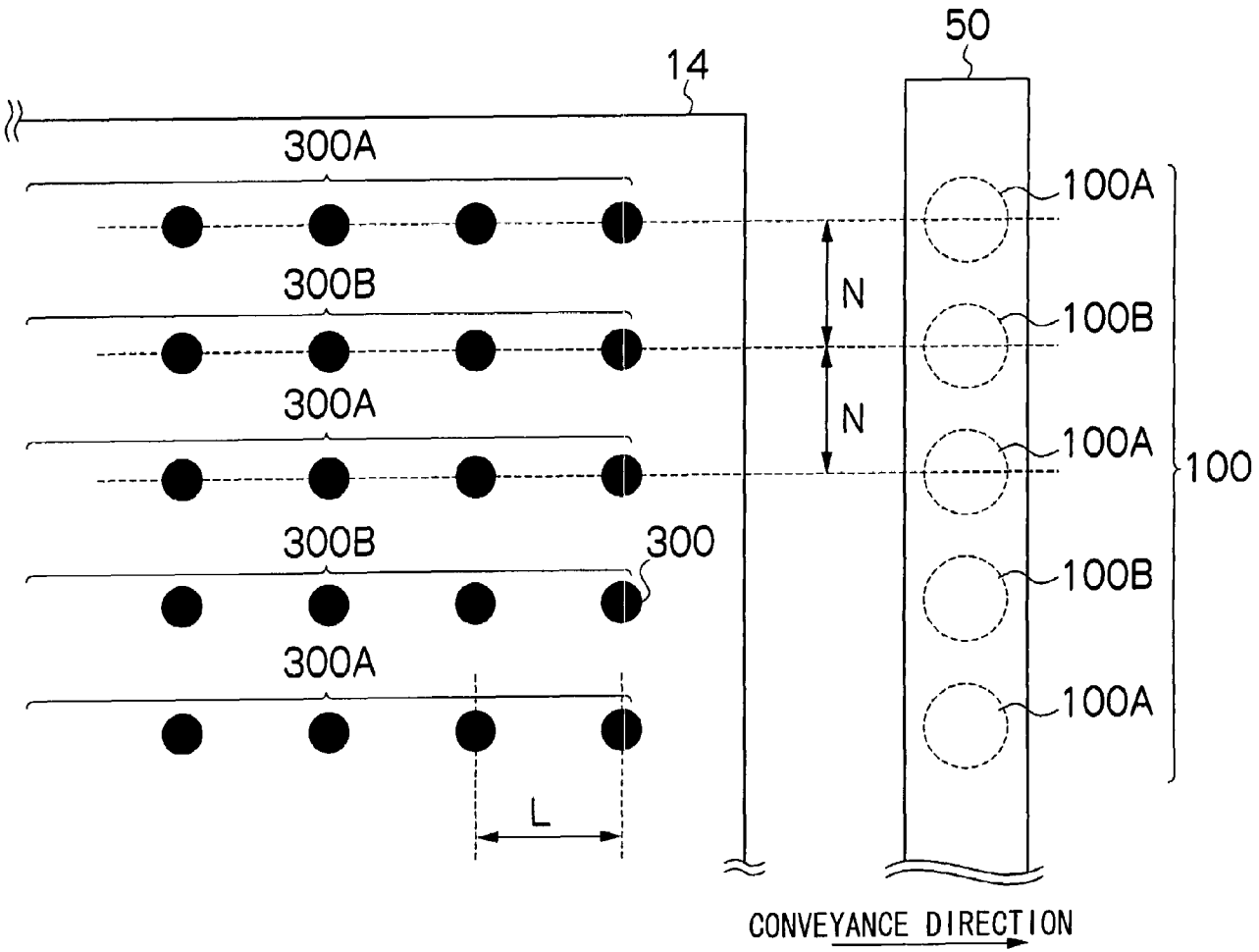
FIG. 7 is a drawing showing the relationship between the nozzles of the print head shown in FIG. 2 and droplet deposition points on recording paper.

FIG. 7 shows the relationship between the droplet deposition point 300 on the recording paper 14 and the print head 50, and it depicts the inkjet recording apparatus 10 illustrated in FIG. 1, as viewed from the printing side (upper side) of the recording paper 14.

The droplet deposition point indicates the point onto which the ink droplet is theoretically deposited, and the position at which the dot caused by the ink droplet is actually situated is displaced by an error component from the droplet deposition point.

As described with reference to FIG. 2, nozzles 100 for discharging ink are arranged in a single row in the main scanning direction, on the surface of the print head 50 which opposes the recording paper 14, and a plurality of these nozzle rows are provided in the sub-scanning direction. In FIG. 7, for the sake of simplicity, the print head 50 is described as being a head having only one row of nozzles. Moreover, FIG. 7 shows only a portion of the nozzles belonging to the print head 50. In FIG. 7, the nozzle pitch N is the interval between two adjacent nozzles.

Droplet deposition points 300 onto which ink droplets are ejected from the respective nozzles are depicted on the recording paper 14 in FIG. 7. The droplet deposition points 300 are situated in a matrix fashion on the recording paper 14, and their arrangement is parallel to the main scanning direction in the row direction and parallel to the sub-scanning direction in the column direction.

The droplet deposition points indicated by reference numeral 300A are droplet deposition points created by nozzle 100A, while those indicated by 300B are droplet deposition points created by nozzle 100B.

In FIG. 7, the arrangement interval between the droplet deposition points in the main scanning direction is the same as the nozzle pitch N, and the arrangement interval in the sub-scanning direction (sub-scanning direction pitch) is indicated by the droplet deposition interval L of the same nozzle in the sub-scanning direction.

The sub-scanning direction pitch L between the droplet deposition points 300 is determined by control of the conveyance of the recording paper 14, and the timing of ejection from the nozzles 100, and in the case of an equivalent resolution of 1600 dpi×800 dpi, N is around 15.9 μm, and L is around 31.8 μm.

FIG. 7 shows a portion of the nozzles 100 and the droplet deposition points 300, and in reality, there exist a large number of nozzles and droplet deposition points.

Figure 8:
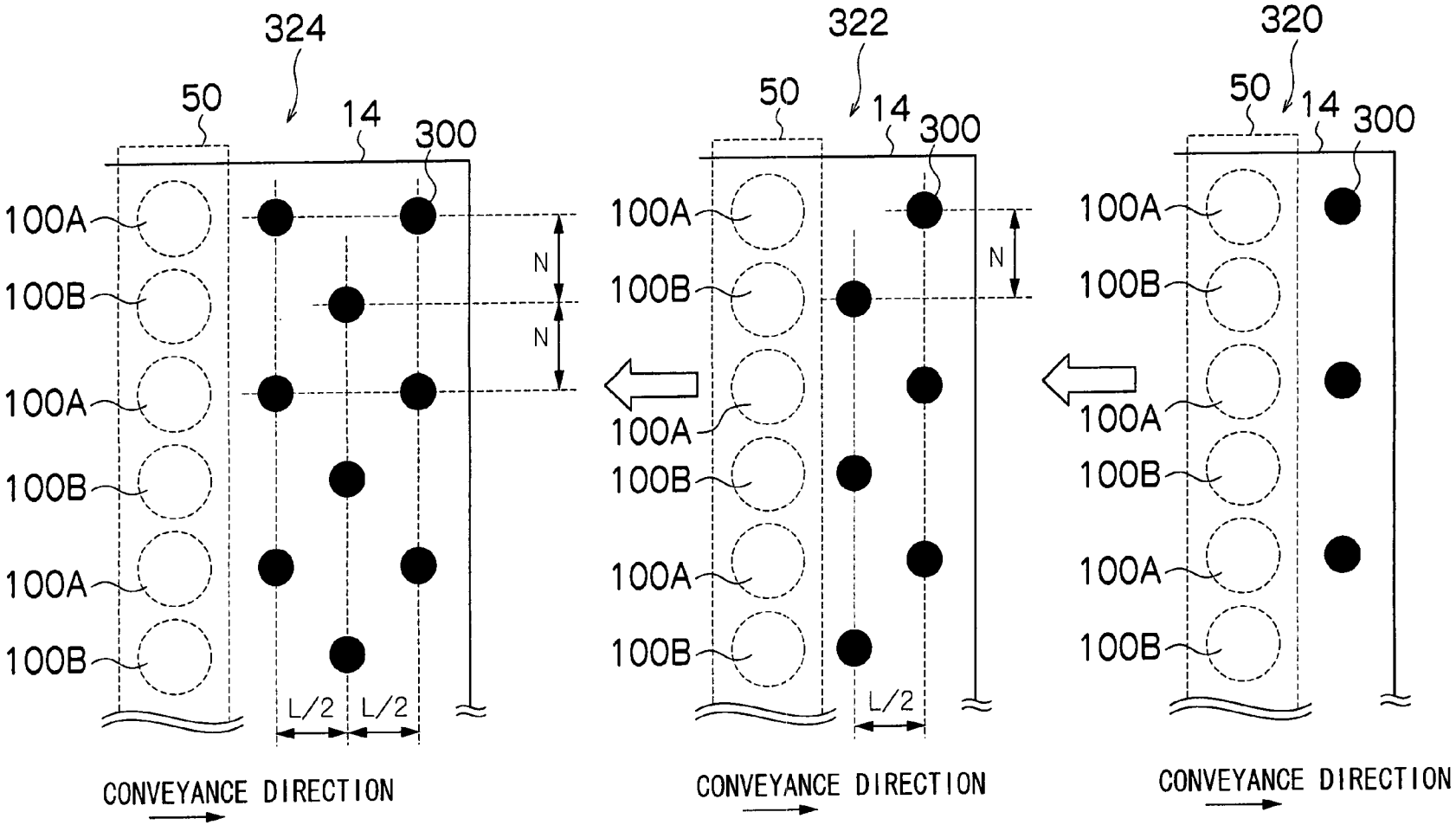
FIG. 8 is a drawing for describing the control of droplet ejection in the inkjet recording apparatus illustrated in FIG. 1.

FIG. 8 is a drawing for describing droplet ejection control wherein the droplet deposition points assume a staggered lattice arrangement. In FIG. 8, items which are the same as or similar to those in FIG. 7 are labeled with the same reference numerals and description thereof is omitted here.

In order to achieve a staggered lattice arrangement for the droplet deposition points, control should be performed in such a manner that the odd-numbered nozzles and the even-numbered nozzles eject droplets in alternating fashion, whereby the droplets are deposited at uniform intervals in the sub-scanning direction. In other words, droplets are ejected from adjacent nozzles at different timings, such that they are mutually separated by half a phase.

More specifically, when droplet ejection for the first row is carried out, dots are formed by ink droplets at the droplet deposition points 300 indicated in 320. In this first-row droplet ejection operation, ink droplets are ejected from the odd-numbered nozzles (for example, 100A), counting from the top of FIG. 8, and no ink droplets are ejected from the even-numbered nozzles (for example, 100B).

The recording paper 14 is then moved in the conveyance direction, and when the recording paper 14 reaches the position for the second-row droplet ejection operation, where the interval between the first-row droplet deposition points and the second-row droplet deposition points, which are deposited by mutually adjacent nozzles, is L/2, when projected to align in the sub-scanning direction, then the droplets for the second row are ejected, and dots are formed by the ink droplets at the droplet deposition points indicated by 322 in FIG. 8. In the second-row droplet ejection operation, ink is not ejected from the odd-numbered nozzles, counting from the top, but ink is ejected from the even-numbered nozzles.

Moreover, the recording paper 14 is conveyed again, and when the recording paper 14 reaches a droplet deposition position for the third row, then third-row droplet ejection is carried out, and dots are formed by ink droplets at the droplet deposition points illustrated in 324. Similarly to the first-row droplet ejection, in the third-row droplet ejection, ink droplets are ejected from the odd-numbered nozzles, counting from the top, and ink droplets are not ejected from even-numbered nozzles, counting from the top. By repeating the droplet ejection step in this manner, it is possible to make the basic arrangement of droplet deposition points 300 assume a staggered lattice arrangement.

Figure 15A:
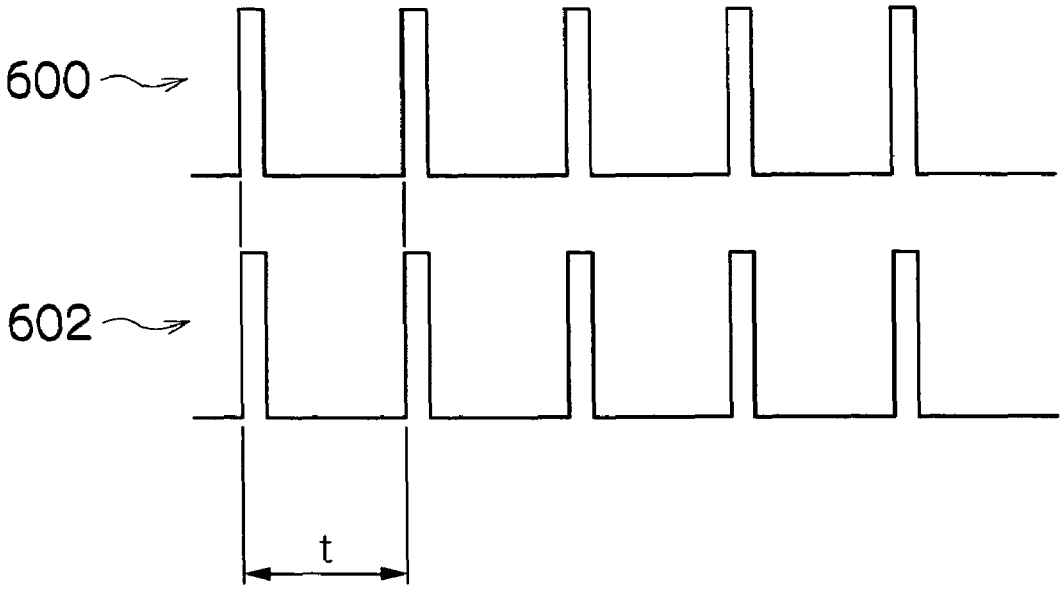
FIGS. 15A and 15B are drawings illustrating the droplet ejection timing of adjacent nozzles.
Figure 15B:
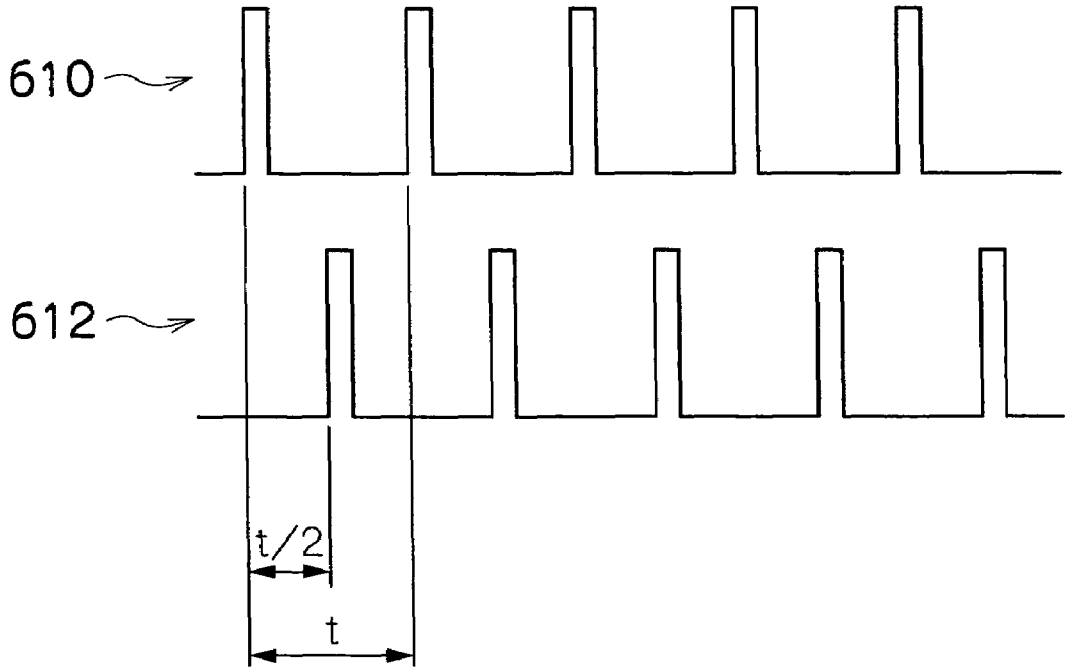

FIG. 15A shows a relationship between the droplet ejection timing of the nozzle 100A and the droplet ejection timing of the nozzle 100B when droplet deposition is performed at droplet deposition points arranged in the square lattice shape shown in FIG. 7 (i.e., when the dots are arranged in a square lattice shape). FIG. 15B shows a relationship between the droplet ejection timing of the nozzle 100A and the droplet ejection timing of the nozzle 100B when droplet deposition is performed at droplet deposition points arranged in the staggered lattice shape shown in FIG. 8 (i.e., when the dots are arranged in a staggered lattice shape).

The reference numerals 600 and 602 in FIG. 15A indicate driving signals for driving the nozzle 100A and the nozzle 100B, respectively, when the dots are arranged in a square lattice shape. The reference numerals 610 and 612 in FIG.

15B indicate driving signals for driving the nozzle 100A and the nozzle 100B, respectively, when the dots are arranged in a staggered lattice shape. The nozzles 100A and 100B are driven so that ink is ejected from the nozzles 100A and 100B at the rising edges (leading edges) of the driving signals 600, 602, 610 and 612.

As shown in FIG. 15A, when the dots are arranged in a square lattice shape, the driving signal 600 and the driving signal 602 are synchronous, and the nozzles 100A and 100B are thereby driven at an identical timing such that ink droplet ejection is performed from the nozzles 100A and 100B simultaneously.

As shown in FIG. 15B, on the other hand, when the dots are arranged in a staggered lattice shape or hexagonal lattice shape, the driving signal 610 and the driving signal 612 are offset by half a phase of a droplet ejection cycle t. The timing at which the nozzles 100A and 100B are driven is thereby offset by t/2, and the timing at which ink is ejected from the nozzles 100A and 100B is thus offset by t/2.

Pulse-form (rectangular wave) driving signals are illustrated in FIGS. 15A and 15B to facilitate understanding of the droplet ejection timing; however, the driving signals for driving the nozzles are not limited to this, and may take a trapezoidal form, a triangular form, or a combination of plural waveforms.

Figure 9:
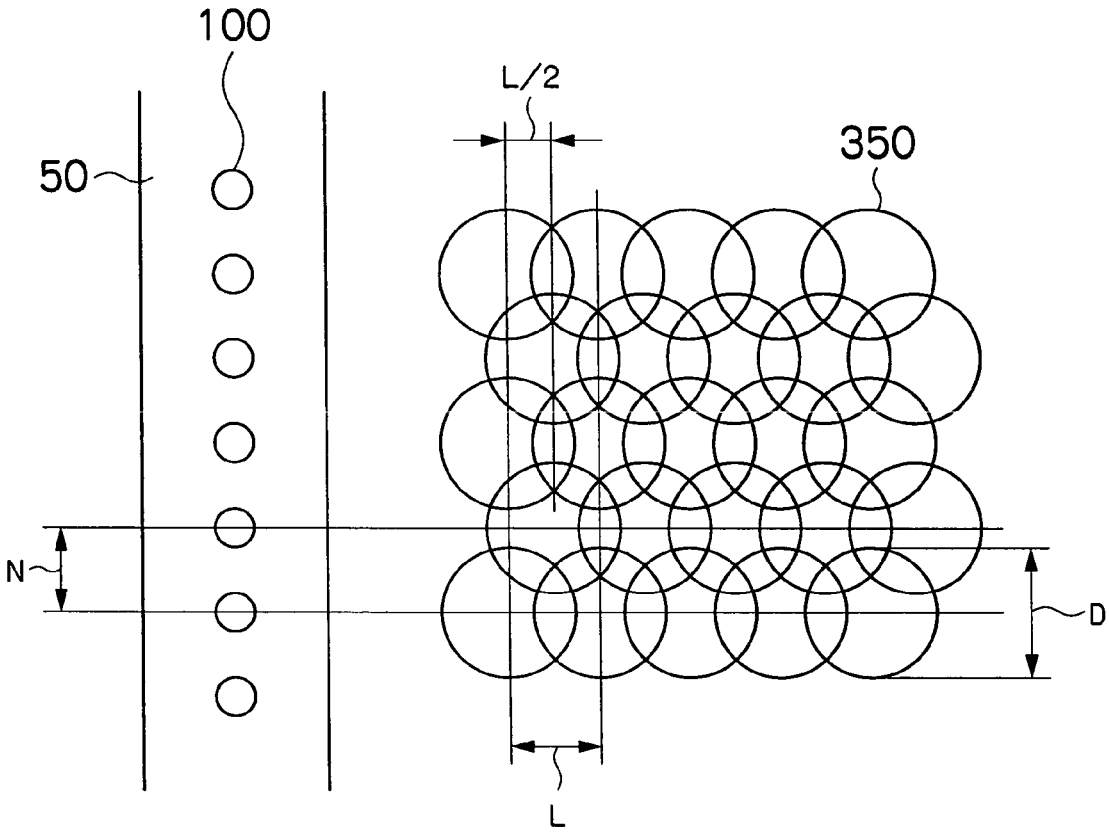
FIG. 9 is a drawing illustrating a staggered lattice arrangement.
Figure 10:
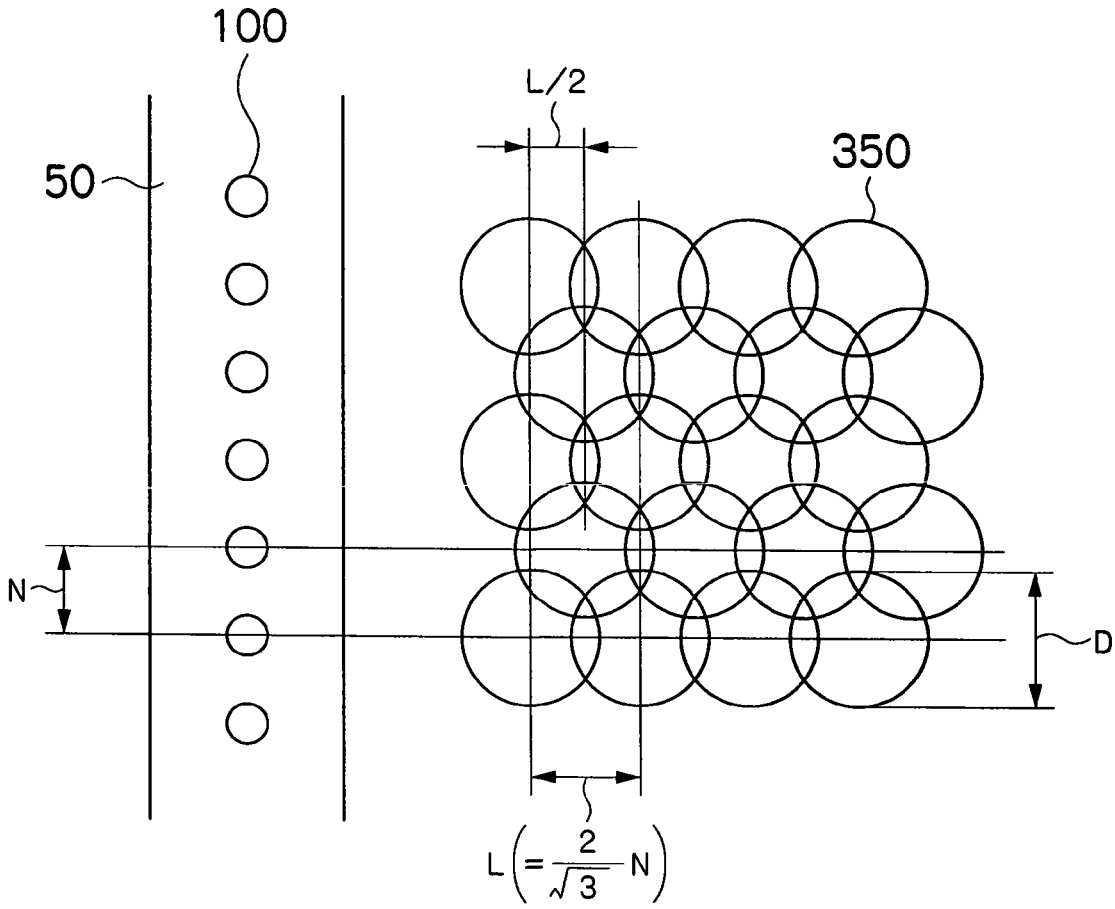
FIG. 10 is a drawing illustrating a hexagonal lattice arrangement.
Figure 11:
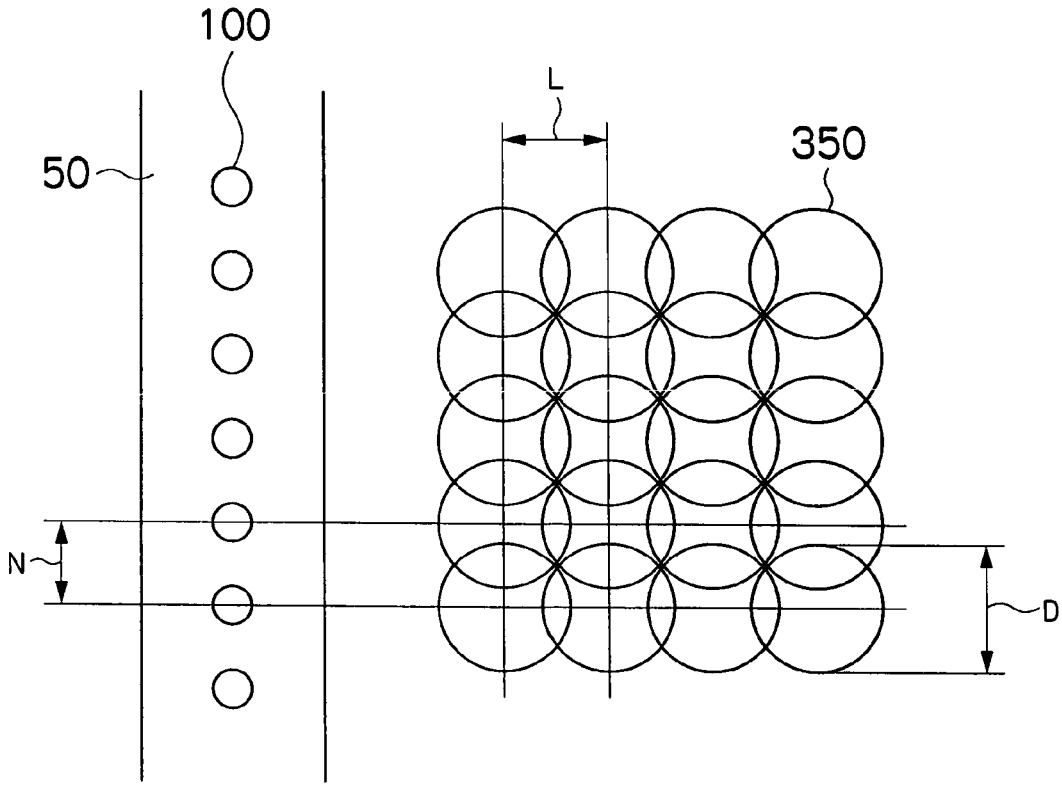
FIG. 11 is a drawing illustrating a square lattice arrangement.

FIGS. 9 to 11 show dots 350 arranged in a staggered lattice arrangement, a hexagonal lattice arrangement, and a square lattice arrangement. In FIGS. 9 to 11, the diameter of the dots (dot size) is indicated by D.

FIG. 9 shows a case where the basic arrangement of the dots 350 is a staggered lattice arrangement, FIG. 10 shows a case where the basic arrangement of the dots 350 is a hexagonal lattice arrangement, and FIG. 11 shows a case where the basic arrangement of the dots 350 is a square lattice arrangement.

In order that streak in the sub-scanning direction is not readily perceptible, it is necessary to form dots 350 in such a manner that mutually adjacent dots are overlapping, in the main scanning direction at least. If the dots 350 are formed in a staggered lattice arrangement or a hexagonal lattice arrangement, then in order for a dot to overlap with the most adjacent dots in the main scanning direction, the relationship between the nozzle pitch N, the dot size D and the droplet deposition interval L in the sub-scanning direction is as indicated in the following inequality (2):

$$D^2>N^2+(L/2)^2. \quad (2)$$

If the inequality (2) is established, then the relationship between the nozzle pitch N and the dot size D always satisfies the condition indicated in the following inequality (3):

$$N<D. \quad (3)$$

On the other hand, the inequality (3) corresponds to conditions wherein mutually adjacent dots are overlapping in the main scanning direction, if the dots 350 are arranged in a square lattice arrangement.

If the dots 350 are arranged in a square lattice fashion, then in order that streak in the main scanning direction is not perceptible, the dots 350 should be formed in such a manner that adjacent dots are overlapping in the sub-scanning direction, at the least, and this should satisfy the conditions stated in the following inequality (4):

$$L<D. \quad (4)$$

In the case of dots arranged in a square lattice arrangement, if the droplet deposition position is displaced in the main scanning direction, then it is possible to make adjacent dots overlap by increasing the dot size, but if the ejection direction of the ink droplets changes due to soiling of the nozzle surface, or the like, then as the state of soiling of the nozzle surface changes, the direction of ejection of the ink droplets also changes further, in accordance with this, and hence the droplet deposition positions fluctuate due to the soiling of the nozzle surface.

In order to respond to this situation, the dot size D should be made larger, but this response leads to wasteful consumption of ink, and increasing the dot size D also runs counter to increasing image resolution and tonal graduation.

By adopting a staggered lattice arrangement or a hexagonal lattice arrangement for the basic arrangement of the dots 350, then even if the droplet deposition position is displaced in the main scanning direction, it is possible to lessen the visual perceptibility of streak in the sub-scanning direction, by controlling the sub-scanning direction pitch L and the dot size D in such a manner that the relationship indicated in the inequality (2) is satisfied.

Moreover, the visual perceptibility of streak is increased if the surface area of the white background surrounding each dot becomes uneven, due to variation in the intervals between adjacent dots. In other words, streak is not liable to be perceptible, provided that there is a white background of uniform area surrounding the dots in each row.

Figure 12:
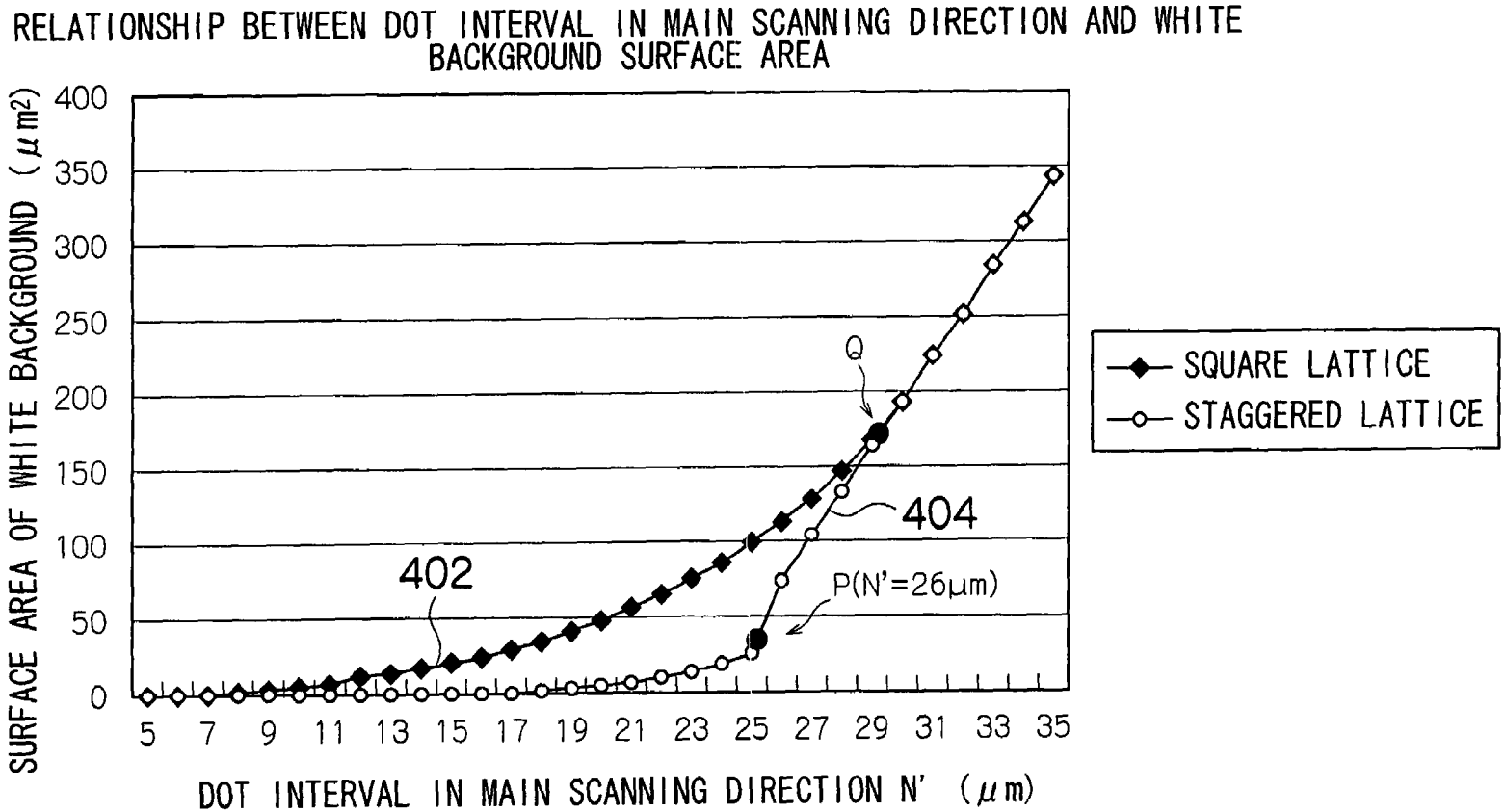
FIG. 12 is a graph showing the relationship between the dot interval in the main scanning direction and the surface area of the white background.

FIG. 12 shows a graph 400 indicating the white background surface area S in one row against change in the dot interval N' in the main scanning direction, in a case where the dot size D is 30 μm and the pitch L in the sub-scanning direction is 15 μm.

In the graph 400, the horizontal axis indicates the dot interval N'(μm) in the main scanning direction, and the vertical axis indicates the white background surface area ($\mu m^2$), and furthermore, numeral 402 indicates a case where the dots are arranged in a square lattice fashion and numeral 404 indicates a case where the dots are arranged in a staggered lattice fashion.

In the case of a staggered lattice arrangement as indicated by numeral 404, the curve turns at point P where the condition in the following equation (5) is satisfied (N'=26 μm):

$$D^2=N'^2+(L/2)^2. \quad (5)$$

The rate of change of the white background surface area S with respect to the change in the dot pitch N' in the main scanning direction is small within the region where the condition in the following inequality (6) is satisfied (the region to the left-hand side of point P in FIG. 12, where N'<26 μm):

$$D^2>N'^2+(L/2)^2. \quad (6)$$

On the other hand, it can be seen that the rate of change of the white background surface area S with respect to change in the dot interval N' in the main scanning direction is large in the region where the condition indicated in the following inequality (7) is satisfied (to the right-hand side of point P in FIG. 12, wherein N'≧26 μm):

$$D^2\leqq N'^2+(L/2)^2 \quad (7)$$

The smaller the change in the white background surface area S with respect to change in the dot interval N' in the main scanning direction, the greater the extent to which the perception of streak generated by positional error in the main scanning direction can be lessened. Stated in other words, in the region where the condition stated in the inequality (6) is satisfied, which is to the left-hand side of the point P in FIG. 12, even if the dot interval N' in the main scanning direction changes, this is not liable to be perceived as streak in the sub-scanning direction.

Figure 13:
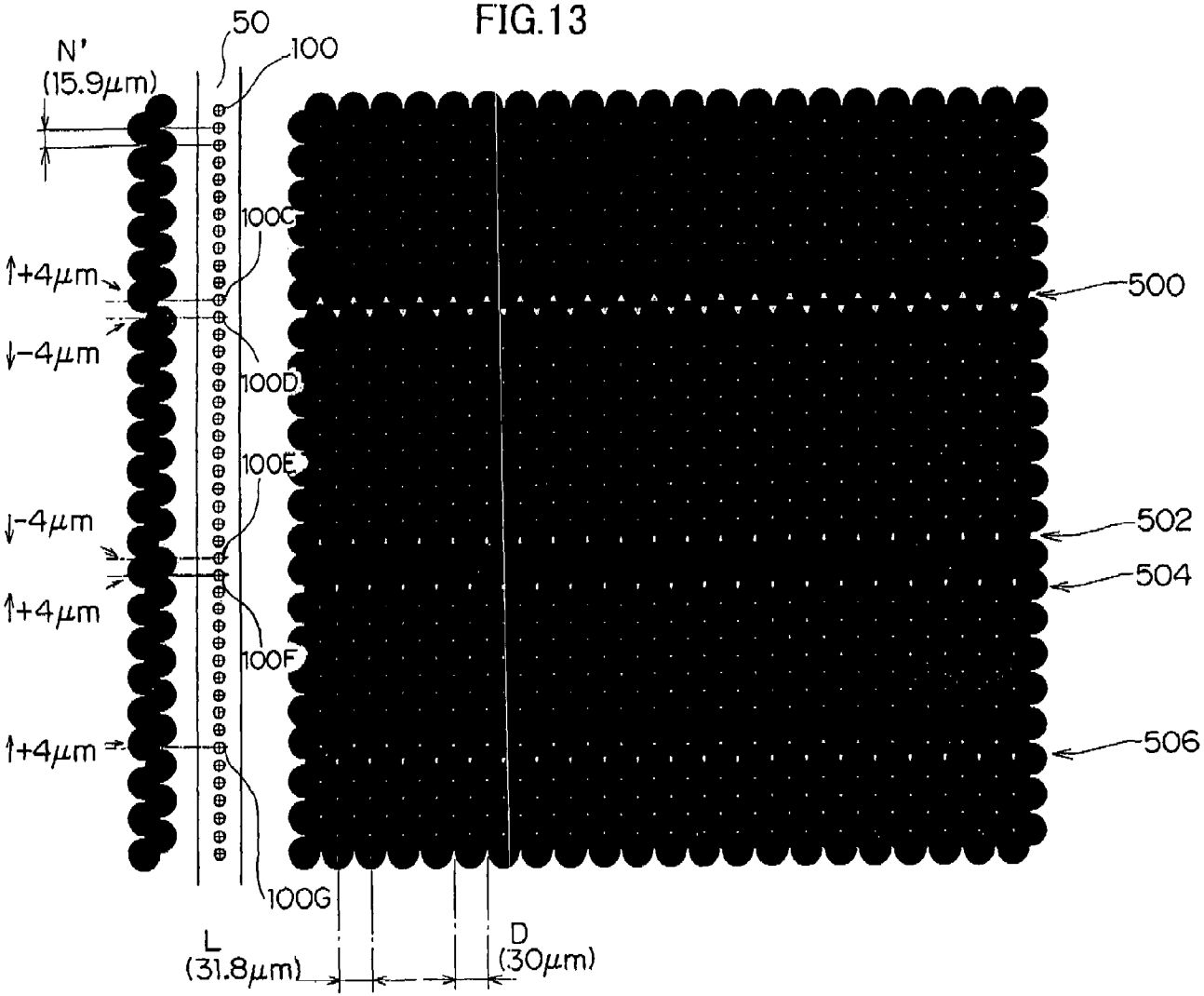
FIG. 13 is a drawing illustrating the perceptibility of streak in the sub-scanning direction, in the case of a staggered lattice arrangement.
Figure 14:
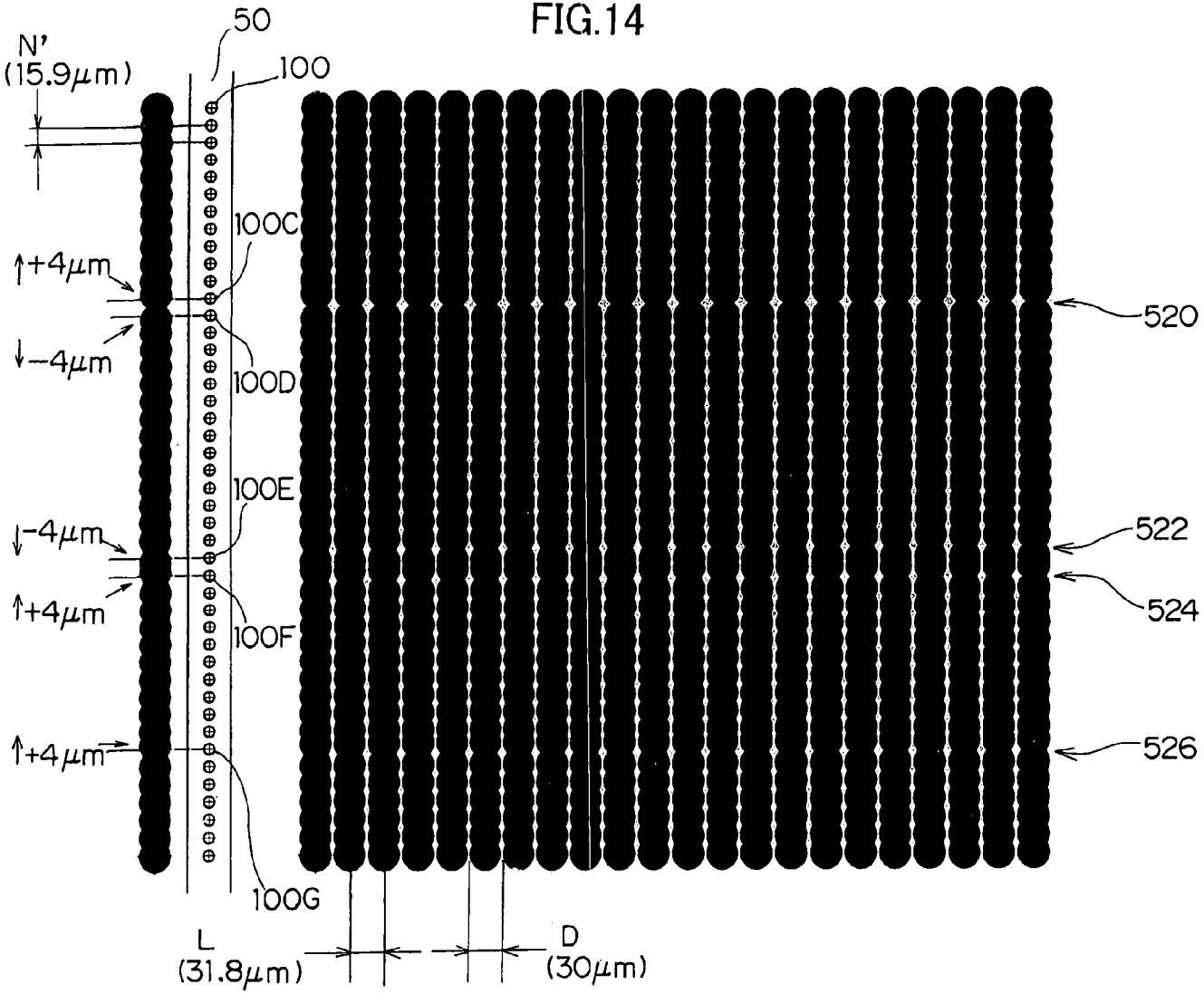
FIG. 14 is a drawing illustrating the perceptibility of streak in the sub-scanning direction, in the case of a square lattice arrangement.

Next, the change in visual perceptibility of streak with respect to change in the arrangement of the dots is described with reference to FIGS. 13 and 14. In FIGS. 13 and 14, it is supposed that D=30 μm, N=15.9 μm, and L=31.8 μm (equivalent to a resolution of 1600×800 dpi). The droplet ejection conditions illustrated in FIG. 13 satisfy the condition stated in the inequality (6) whereby the perceptibility of streak can be lessened in cases where the dots are arranged in a staggered lattice fashion.

FIG. 13 shows a case where the dots 350 are disposed in a staggered lattice arrangement, and FIG. 14 shows a case where the dots 350 are disposed in a square lattice arrangement.

FIGS. 13 and 14 illustrate streaks in a case where the droplet deposition points created by two adjacent nozzles are displaced in mutually separating directions, a case where the droplet deposition points created by two adjacent nozzles are displaced in mutually approaching directions, and a case where the droplet deposition points created by any one nozzle are displaced.

Firstly, in the case where the droplet deposition points created by two adjacent nozzles are displaced in mutually separating directions, the droplet deposition positions created by the nozzle 100C are displaced by 4 μm in the upward direction in FIGS. 13 and 14, and the droplet deposition positions created by the nozzle 100D are displaced by 4 μm in the downward direction in FIGS. 13 and 14, and with the staggered lattice arrangement, the streak 500 illustrated in FIG. 13 is obtained, whereas with the square lattice arrangement, the streak 520 illustrated in FIG. 14 is obtained. Comparing the streak 500 shown in FIG. 13 with the streak 520 shown in FIG. 14, it can be seen that the streak 520 is more readily perceptible.

In the case where the droplet deposition points created by two adjacent nozzles are displaced in mutually approaching directions, the droplet deposition positions created by the nozzle 100E are displaced by 4 μm in the downward direction in FIGS. 13 and 14, and the droplet deposition positions created by the nozzle 100F are displaced upwards by 4 μm in the downward direction in FIGS. 13 and 14, and with the staggered lattice arrangement, the streak 502 illustrated in FIG. 13 is obtained, whereas with the square lattice arrangement, the streaks 522, 524 illustrated in FIG. 14 are obtained. When the streaks 502, 504 illustrated in FIG. 13 are compared with the streaks 522, 524 illustrated in FIG. 14, the streaks 502, 504 are barely perceptible, whereas the streaks 522, 524 shown in FIG. 14 is readily perceptible as streaks.

Furthermore, in the case where the droplet deposition points created by any one nozzle are displaced, if the droplet deposition positions created by the nozzle 100G are displaced by 4 μm in the upward direction in FIGS. 13 and 14, then with a staggered lattice arrangement, the streak 506 shown in FIG. 13 is obtained, and with a square lattice arrangement, the streak 526 shown in FIG. 14 is obtained. The streak 506 shown in FIG. 12 is barely perceptible, similarly to the streaks 502 and 504, whereas the streak 526 illustrated in FIG. 14 is readily perceptible as streaks, similarly to the streaks 522 and 524.

When FIGS. 13 and 14 are compared, it can be seen that if the condition stated in the inequality (6) is satisfied, then the visual perceptibility of streak in the sub-scanning direction can be lessened, with respect to positional displacement of the dot positions in the main scanning direction, by adopting a staggered lattice arrangement (hexagonal lattice arrangement) for the dot arrangement.

Next, the algorithms of the droplet ejection control described above will be described in detail.

Figure 16:
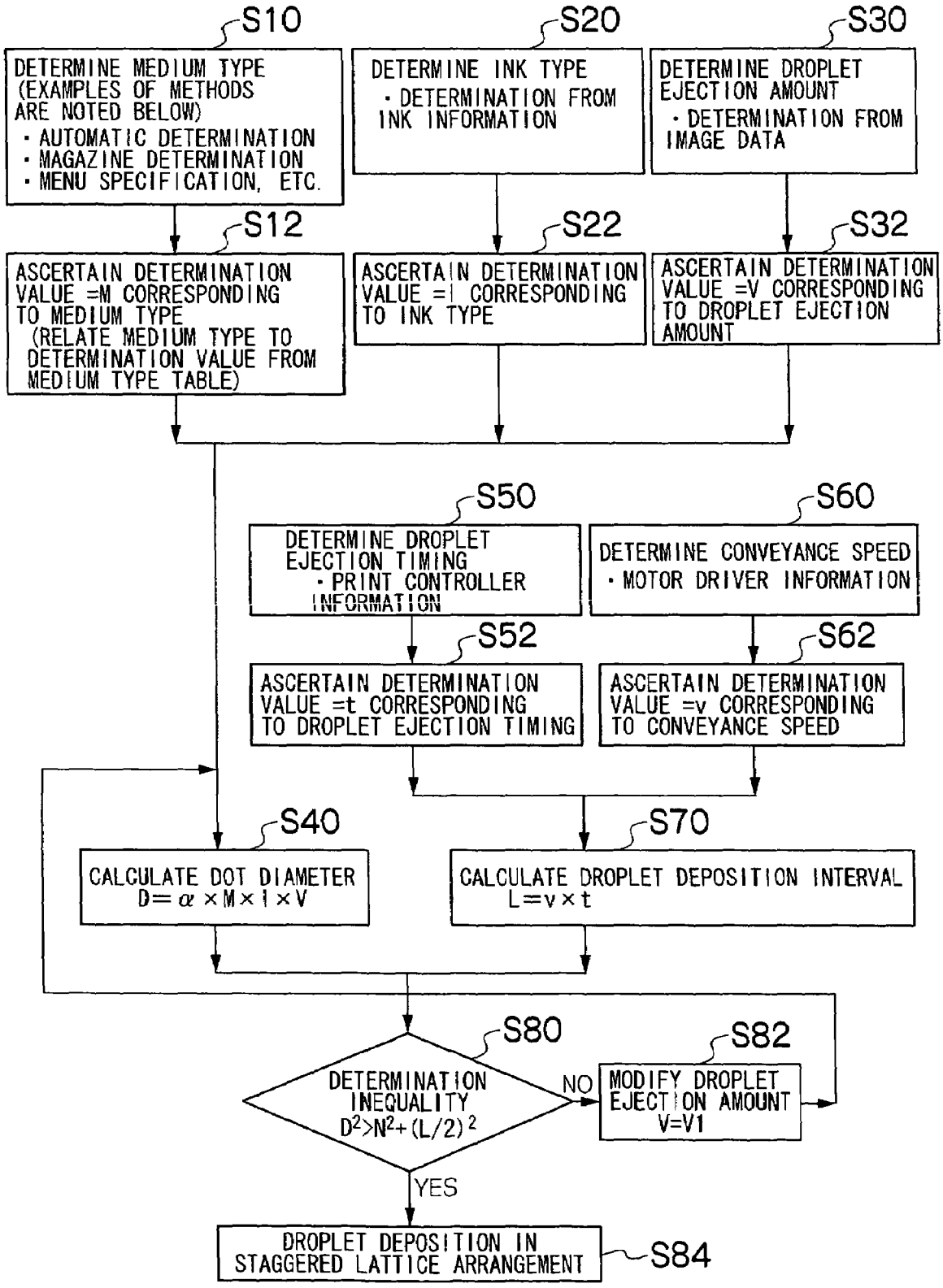
FIG. 16 is a flowchart illustrating the flow of droplet ejection control according to an embodiment of the present invention.

FIG. 16 is a flowchart showing the algorithms of the droplet ejection control described above.

In the inkjet recording apparatus 10, the type of the recording paper 14 (the medium type) is determined according to the medium type information acquired by the medium type determination unit 242 shown in FIG. 6 (step S10).

After the medium type to be used is determined in the medium type determination shown in step S10 using a method such as automatic determination, magazine determination, or menu specification, a determination value (=M) corresponding to the determination result (specified medium) is ascertained (step S12). This determination value (=M) is read from a medium type table (a data table in which medium types are related to determination values) recorded in a recording unit such as the image memory shown in FIG. 6.

Moreover, the ink type is determined according to the ink type information acquired by the ink type determination unit 240 shown in FIG. 6 (step S20), and a determination value (=I) corresponding to the ink type is ascertained (step S22).

Furthermore, in the print control unit 208 shown in FIG. 6, dot data (data comprising the dot disposal and dot diameter) are generated from the image data acquired from the host computer 202. The droplet ejection amount is determined from these dot data (step S30), and a determination value (=V) corresponding to the droplet ejection amount is ascertained (step S32).

The dot diameter D of each dot is determined from the determination values M, I and V ascertained as described above. In other words, the dot diameter D is calculated according to the following equation (8) (step S40):

$$D=\alpha\times M\times I\times V, \tag{8}$$

where α is a predetermined constant.

Furthermore, after the dot data are generated from the image data in the print controller 208 shown in FIG. 6, the droplet ejection timing is determined from the print controller information (step S50), whereupon a determination value (=t) corresponding to the droplet ejection timing is ascertained (step S52).

The conveyance speed is then determined from the motor driver information (step S60), whereupon a determination value (=v) corresponding to the conveyance speed is ascertained.

The droplet deposition interval L shown in FIGS. 7 to 11 is then determined from the determination value t corresponding to the droplet ejection timing and the determination value v corresponding to the conveyance speed determined as described above (step S70). The droplet deposition interval L is calculated according to the following equation (9):

$$L=v\times t. \tag{9}$$

A determination is then made as to whether or not the dot diameter D and the droplet deposition interval L determined as described above satisfy the aforementioned inequality (2): $D^2>N^2+(L/2)^2$ (step S80). If the dot diameter D and the droplet deposition interval L do not satisfy the inequality (2)

(a NO determination), the droplet ejection amount V is modified to V1 (step S82), and the routine advances to step S40.

If, on the other hand, the dot diameter D and the droplet deposition interval L satisfy the inequality (2) (a YES determination), droplet ejection is performed such that the dots are disposed in the staggered lattice shape shown in FIGS. 8 and 9 (step S84).

Figure 17:
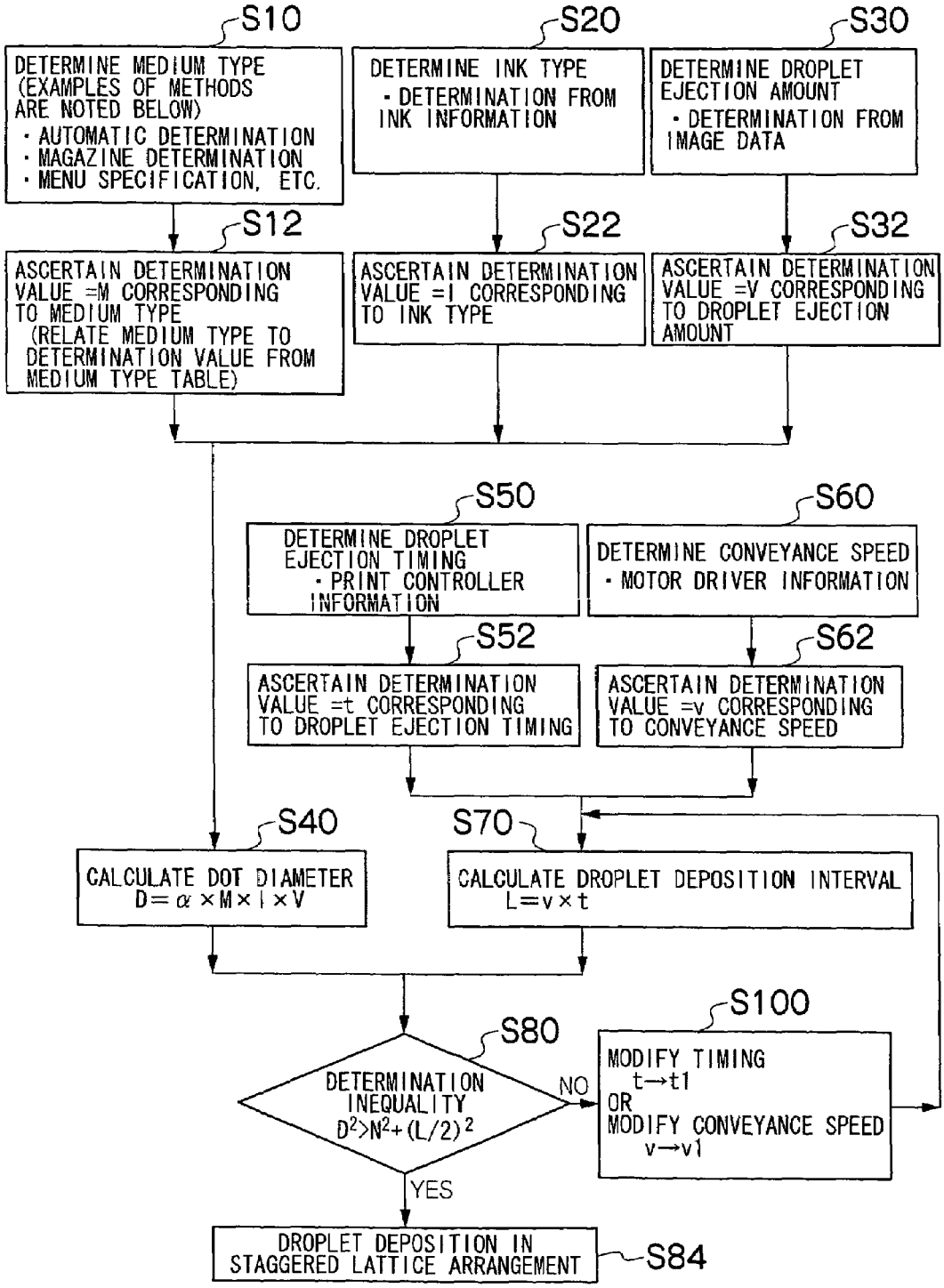
FIG. 17 is a flowchart illustrating one aspect of the droplet ejection control shown in FIG. 16.
Figure 18:
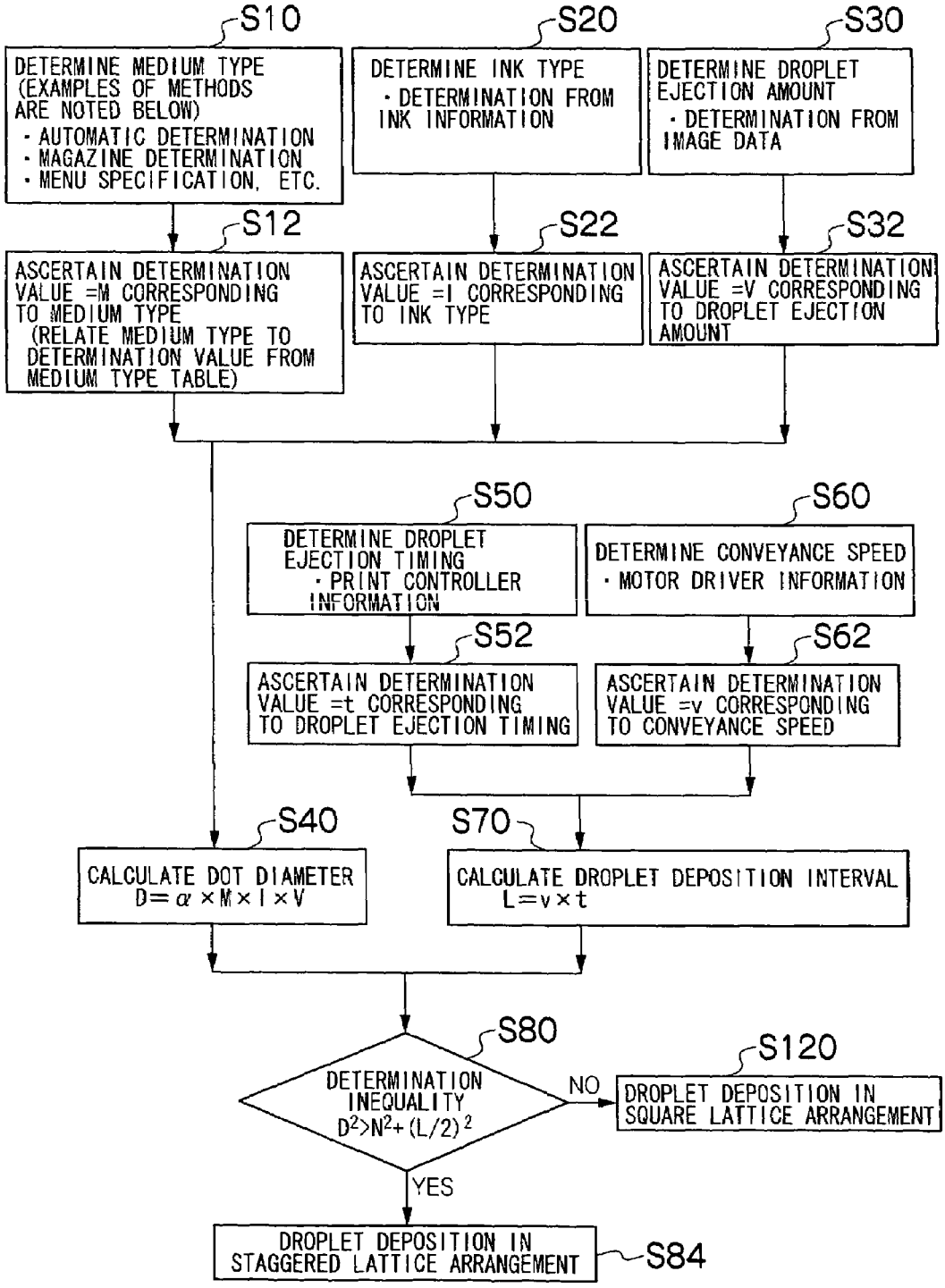
FIG. 18 is a flowchart illustrating another aspect of the droplet ejection control shown in FIG. 16.

FIGS. 17 and 18 show modified examples of the control algorithms shown in FIG. 16.

In the aspect shown in FIG. 17, when the dot diameter D and the droplet deposition interval L do not satisfy the inequality (2) (a NO determination) in step S80, at least one modification from among modification of the droplet ejection timing t to t1 and modification of the conveyance speed v to v1 (step S100) is made in place of step S82 in FIG. 16.

In the aspect shown in FIG. 18, when the dot diameter D and the droplet deposition interval L do not satisfy the inequality (2) (a NO determination) in step S80, the droplet ejection timing is modified and droplet ejection is performed such that the dots are arranged in a square lattice shape (step S120) in place of step S82 in FIG. 16.

In the present embodiment, the head is described as having one row of nozzles arranged in the main scanning direction, but if a plurality of rows of nozzles are arranged in the sub-scanning direction, then the droplet ejection control described above should be implemented in each nozzle row. Furthermore, it is also possible to adopt a composition whereby the droplet ejection control described above is carried out selectively for a number of nozzle rows.

Furthermore, in the present embodiment, a situation is described wherein one print head is provided, but if the present invention is applied to a situation wherein a plurality of print heads are provided, then each print head should be composed in such a manner that the droplet ejection control described above can be carried out respectively therein. In the case of a six-colors head which is also provided with light-color inks, it is possible to adopt a composition wherein the droplet ejection control described above is applied to all of the heads apart from the light-color ink heads.

The inkjet recording apparatus 10 having the foregoing composition is able to lessen the visual perceptibility of streak, inexpensively, and involving little burden on the system, by adopting a staggered lattice arrangement or a hexagonal lattice arrangement for the basic arrangement of the droplet deposition points, by shifting the droplet ejection timing of adjacent nozzles by approximately half a wavelength, in the combination of dot size, nozzle density and droplet ejection frequency.

Moreover, the visual perceptibility of streak is increased if the surface area of the adjacent white backgrounds becomes uneven, due to variation in the intervals between adjacent dots. If the white background surface area is even between respective positions, then unevenness is not perceived.

Here, application examples of the present embodiment are described.

In the inkjet recording apparatus 10, a composition is achieved whereby the droplet ejection timing of each nozzle is controlled in such a manner that, during high-quality output (for example, the region satisfying the inequality (6), assuming that the basic arrangement of the droplet deposition points is a staggered lattice arrangement or a hexagonal lattice arrangement), the basic arrangement of the droplet deposition points becomes a staggered lattice arrangement or a hexagonal lattice arrangement, and during low-quality output (for example, the region satisfying the inequality (7), assuming that the basic arrangement of the droplet deposition points is a staggered lattice arrangement or a hexagonal lattice arrangement), the basic arrangement of the droplet deposition points becomes a square lattice arrangement.

As illustrated in FIG. 12, in the region to the right-hand side of the turning point P, up to and including the left-hand side of point Q where the two graphs meet, the amount of change in the surface area of the white background with respect to change in the dot interval N' in the main scanning direction is greater in the case of a staggered lattice arrangement than in the case of a square lattice arrangement, and therefore the staggered lattice arrangement becomes disadvantageous in that streak in the sub-scanning direction becomes more perceptible. Consequently, a square lattice arrangement is preferable in the region to the right-hand side of the turning point P and to the left-hand side of the point Q.

In an inkjet recording apparatus 10 having a composition of this kind, the base arrangement can be changed selectively, in such a manner that a staggered lattice arrangement or a hexagonal lattice arrangement is adopted in the case of high-quality output, and a square lattice arrangement is adopted n the case of low-quality output.

In the case of high-quality output, the droplet deposition points are densely spaced, and the staggered lattice arrangement (hexagonal lattice arrangement) allows the perceptibility of streak in the sub-scanning direction to be lessened to a greater extent that a square lattice arrangement, whereas in the case of low-quality output, the droplet deposition points are loosely spaced, the perceptibility of streak in the sub-scanning direction is essentially low, and even if a staggered lattice arrangement (hexagonal lattice arrangement) is adopted, a corresponding effect in lessening the perceptibility of streak in the sub-scanning direction cannot be expected, for which reason, a square lattice arrangement is adopted, in order to simplify the control of droplet ejection.

An inkjet recording apparatus is described as one example of an image forming apparatus in the foregoing embodiment, but the range of application of the present invention is not limited to this. The present invention may also be applied to an LED printer, by changing the dot size by means of the aperture or magnification factor of the imaging lens.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a full line type recording head which includes a plurality of nozzles for discharging ink arranged in a nozzle row across an entire printable width in a main scanning direction;

a conveyance device which moves a recording medium and the recording head relatively to each other in a sub-scanning direction substantially orthogonal to the nozzle row provided in the recording head; and a droplet ejection control device which determines a basic arrangement of droplet deposition points of dots to be formed on the recording medium in accordance with a density of the dots to be formed on the recording medium, and controls a droplet ejection timing of each nozzle in such a manner that the basic arrangement of the droplet deposition points of the dots formed on the recording medium by ink droplets ejected from the nozzles assumes the basic arrangement thus determined, wherein the droplet ejection control device controls the droplet ejection timing of each nozzle, in such a manner that if the following inequality is satisfied:

$$D^2 > N^2 + (L/2)^2,$$

where the basic arrangement for the droplet deposition points of the dots formed on the recording medium is assumed to a staggered lattice arrangement, D is the diameter of the dot, N is a projected nozzle interval when projected to align in the main scanning direction, and L is a projected droplet deposition interval when projected to align the droplet deposition points of a same nozzle in the sub-scanning direction, then droplets are deposited in the staggered lattice arrangement as the basic arrangement;

whereas if the above inequality is not satisfied, then droplets are deposited in a square lattice arrangement as the basic arrangement.

2. A recording method for an inkjet recording apparatus, comprising:

discharging ink from a full line type recording head having a plurality of nozzles arranged in a nozzle row across an entire printable width in a main scanning direction;

moving a recording medium and the recording head relatively to each other in a sub-scanning direction substantially orthogonal to the nozzle row provided in the recording head;

determining a basic arrangement of droplet deposition points of dots to be formed on the recording medium in accordance with a density of the dots to be formed on the recording medium; and controlling a droplet ejection timing of each nozzle in such a manner that the basic arrangement of the droplet deposition points of the dots formed on the recording medium by ink droplets ejected from the nozzles assumes the basic arrangement thus determined, wherein the droplet ejection control device controls the droplet ejection timing of each nozzle, in such a manner that:

if the following inequality is satisfied:

$$D^2 > N^2 + (L/2)^2,$$

where the basic arrangement for the droplet deposition points of the dots formed on the recording medium is assumed to a staggered lattice arrangement, D is the diameter of the dot, N is a projected nozzle interval when projected to align in the main scanning direction, and L is a projected droplet deposition interval when projected to align the droplet deposition points of a same nozzle in the sub-scanning direction, then droplets are deposited in the staggered lattice arrangement as the basic arrangement;

whereas if the above inequality is not satisfied, then droplets are deposited in a square lattice arrangement as the basic arrangement.

* * * * *